US011066903B2

(12) United States Patent
MacDougall et al.

(10) Patent No.: US 11,066,903 B2
(45) Date of Patent: Jul. 20, 2021

(54) APPARATUS AND METHODS FOR WELL INTERVENTION

(71) Applicant: Schlumberger Technology Corporation, Sugar Land, TX (US)

(72) Inventors: Thomas MacDougall, Sugar Land, TX (US); Mark Milkovisch, Cypress, TX (US); Todor Sheiretov, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/773,458

(22) Filed: Jan. 27, 2020

(65) Prior Publication Data

US 2020/0173258 A1 Jun. 4, 2020

Related U.S. Application Data

(62) Division of application No. 15/191,575, filed on Jun. 24, 2016, now Pat. No. 10,544,657.

(51) Int. Cl.

| | |
|---|---|
| ***E21B 34/14*** | (2006.01) |
| ***E21B 41/00*** | (2006.01) |
| ***E21B 34/06*** | (2006.01) |
| ***E21B 47/12*** | (2012.01) |
| ***E21B 23/01*** | (2006.01) |
| ***E21B 47/092*** | (2012.01) |
| *E21B 23/00* | (2006.01) |

(52) U.S. Cl.

CPC ..... *E21B 41/00* (2013.01); *E21B 23/01* (2013.01); *E21B 34/06* (2013.01); *E21B 47/092* (2020.05); *E21B 47/12* (2013.01); *E21B 23/001* (2020.05); *E21B 2200/04* (2020.05); *E21B 2200/06* (2020.05)

(58) Field of Classification Search

CPC ..... E21B 34/14; E21B 31/107; E21B 23/00; E21B 34/066; E21B 2034/007; E21B 31/005

See application file for complete search history.

(56) References Cited

U.S. PATENT DOCUMENTS

| | | | |
|---|---|---|---|
| 1,901,513 | A | 3/1933 | Harris |
| 3,173,501 | A | 3/1965 | Moore |
| 4,509,593 | A | 4/1985 | Traver et al. |
| 4,932,483 | A | 6/1990 | Rear |
| 5,309,988 | A | 5/1994 | Shy et al. |
| 6,745,836 | B2 | 6/2004 | Taylor et al. |
| 6,986,394 | B2 | 1/2006 | Marsh |
| 7,367,397 | B2 | 5/2008 | Clemens et al. |
| 8,210,251 | B2 | 7/2012 | Lynde et al. |

(Continued)

FOREIGN PATENT DOCUMENTS

WO 2002095180 A2 11/2002

*Primary Examiner* — Kipp C Wallace

(57) ABSTRACT

A downhole tool string for conveying within a wellbore, including an engagement device for engaging a downhole feature located within the wellbore, a first actuator for applying a substantially non-vibrating force to the engagement device while the engagement device is engaged with the downhole feature, and a second actuator for applying a vibrating force to the engagement device while the engagement device is engaged with the downhole feature.

14 Claims, 8 Drawing Sheets

(56) References Cited

U.S. PATENT DOCUMENTS

| | | | | |
|---|---|---|---|---|
| 9,133,671 | B2 | 9/2015 | Kellner | |
| 2011/0120726 | A1* | 5/2011 | Murray | E21B 23/006 166/373 |
| 2011/0146975 | A1* | 6/2011 | O'Malley | E21B 34/14 166/250.15 |
| 2011/0192222 | A1 | 8/2011 | Vetter | |
| 2014/0174726 | A1 | 6/2014 | Harrigan et al. | |
| 2016/0069146 | A1 | 3/2016 | Livescu et al. | |
| 2016/0123112 | A1 | 5/2016 | Purkis | |
| 2016/0177669 | A1* | 6/2016 | Avant | E21B 23/006 166/331 |
| 2017/0058644 | A1* | 3/2017 | Andreychuk | E21B 23/006 |
| 2017/0130557 | A1* | 5/2017 | Pratt | F16K 31/082 |
| 2017/0167227 | A1 | 6/2017 | Lee et al. | |
| 2017/0370189 | A1 | 12/2017 | MacDougall et al. | |

* cited by examiner

APPARATUS AND METHODS FOR WELL INTERVENTION

CROSS-REFERENCE TO RELATED APPLICATIONS

This application is a divisional application and claims the benefit of and priority to U.S. patent application Ser. No. 15/191,575, titled "Apparatus and Methods for Well Intervention," filed Jun. 24, 2016, the entirety of which is incorporated herein by reference for all purposes.

BACKGROUND OF THE DISCLOSURE

Intervention operations in completed wells may entail actuation of various fluid valves, such as formation isolation valves, installed within the wellbore. For example, the valves may be installed during completion operations and then generally remain closed to prevent fluid transfer between the wellbore and the formation while still permitting the passage, through the valves, of tubing, tools, and/or tools other equipment. For subsequent operations, the valves may be remotely opened remotely by applying a sequence of pressure pulses. If the opening mechanism of one of the valves becomes stuck, such that the applied pressure pulses are insufficient to actuate the valve, a downhole tool may be conveyed into the wellbore and utilized to mechanically open the valve. However, sand or other contaminants may even prevent such mechanical actuation of the valve. Accordingly, wellsite operators may apply increasing mechanical forces to the stuck valve in attempting to unstick the valve. However, the increased forces may further exacerbate the situation, perhaps resulting in further jamming or seizing the valve, and potentially damaging the valve.

Accordingly, a cleanup operation may be conducted prior to attempting to actuate the valves. The cleanup operation may utilize coiled tubing with a milling tool fitted with a brush bit and a debris collection tool to clean out residual fracturing sand and/or other debris that may otherwise cause the valves to stick. However, the cost, equipment footprint at the wellsite, and operational time associated with coiled tubing operations can make this option less than optimal.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a downhole tool string for conveying within a wellbore. The downhole tool string includes an engagement device operable to engage a downhole feature located within the wellbore, a first actuator operable to apply a substantially non-vibrating force to the engagement device while the engagement device is engaged with the downhole feature, and a second actuator operable to apply a vibrating force to the engagement device while the engagement device is engaged with the downhole feature.

The present disclosure also introduces a method that includes operating a first actuator to impart a substantially non-vibrating force to a downhole feature located within a wellbore, and operating a second actuator to impart a vibrating force to the downhole feature.

The present disclosure also introduces a method that includes positioning a downhole tool string relative to a downhole feature within a wellbore. The downhole tool string is in communication with surface equipment disposed at a wellsite surface from which the wellbore extends, and the downhole tool string and/or the surface equipment individually or collectively include a controller comprising a processor and a memory storing computer program code. The method also includes engaging the downhole feature with an engagement device of the downhole tool string, and operating the controller to control an actuator of the downhole tool string to impart movements to the engagement device and the downhole feature in first and second directions. The movements are of different distances to achieve a net repositioning of the downhole feature in the first or second direction.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
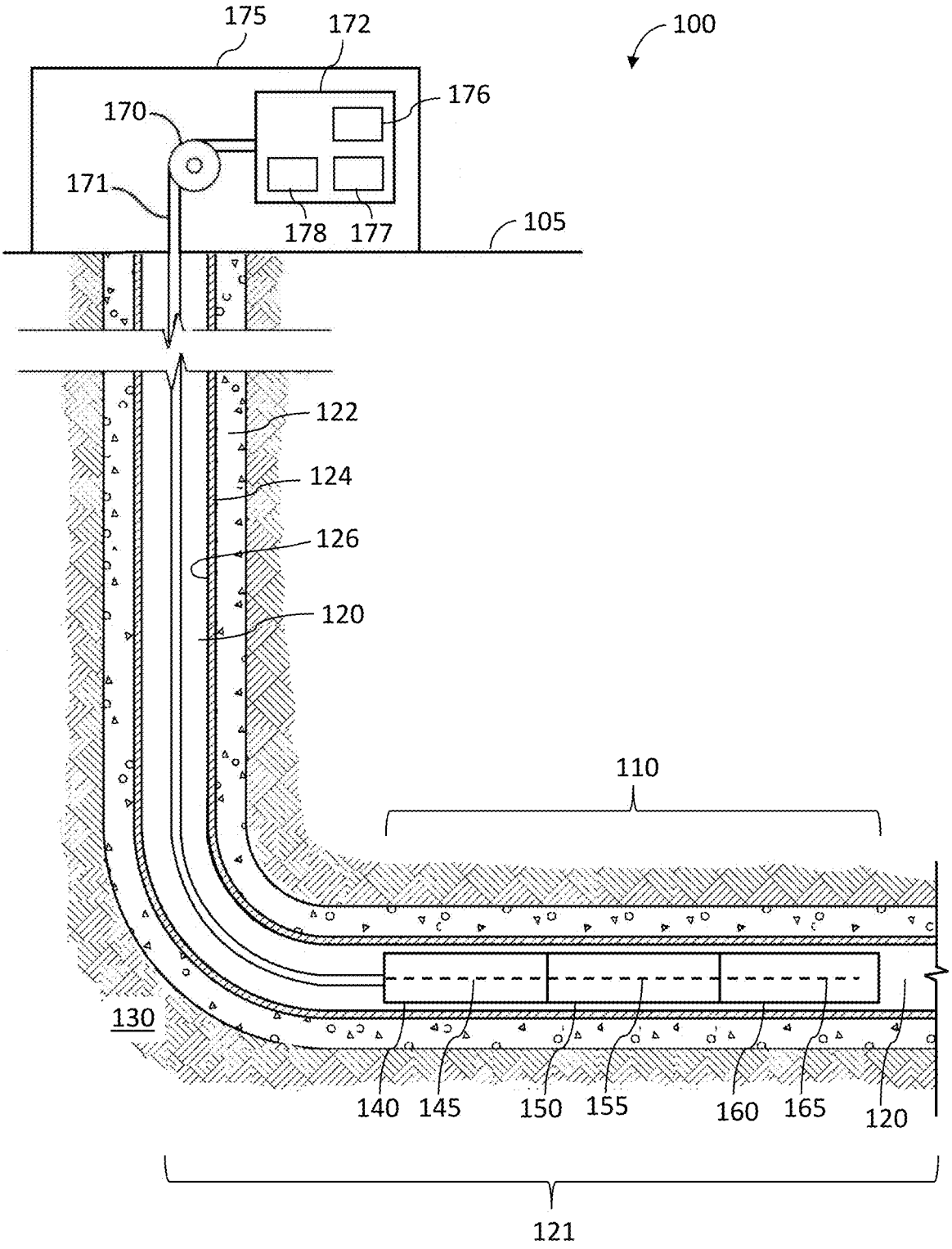
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

FIG. 1 is a schematic view of at least a portion of a wellsite system 100 according to one or more aspects of the present disclosure. The wellsite system 100 may comprise a tool string 110 suspended within a wellbore 120 that extends from a wellsite surface 105 into one or more subterranean formations 130. The wellbore 120 is depicted as being a cased-hole implementation comprising a casing 124 secured by cement 122. However, one or more aspects of the present disclosure are also applicable to and/or readily adaptable for utilizing in open-hole implementations lacking the casing 124 and cement 122. Also, the tool string 110 is depicted located within a horizontal portion 121 of the wellbore 120. However, it is to be understood that the tool string 110 within the scope of the present disclosure may be utilized in vertical, diagonal, and otherwise deviated portions of the wellbore 120.

The tool string 110 may be suspended within the wellbore 120 via a conveyance means 171 operably coupled with a tensioning device 170 and/or other surface equipment 175 disposed at the wellsite surface 105, including a power and control system 172. The tensioning device 170 may be operable to apply an adjustable tensile force to the tool string 110 via the conveyance means 171. The tensioning device 170 may be, comprise, or form at least a portion of a crane, a winch, a drawworks, a top drive, and/or another lifting device coupled to the tool string 110 by the conveyance means 171. The conveyance means 171 may be or comprise a wireline, a slickline, an e-line, coiled tubing, drill pipe, production tubing, and/or other conveyance means, and may comprise and/or be operable in conjunction with means for communication between the tool string 110, the tensioning device 170, and/or one or more other portions of the surface equipment 175, including the power and control system 172. The conveyance means 171 may comprise a multi-conductor wireline, comprising electrical and/or optical conductors extending between the tool string 110 and the surface equipment 175. The power and control system 172 may include a source of electrical power 176, a memory device 177, and a controller 178 operable to process signals or information, and send the processed signals or information to the tool string 110. The controller 178 may also be operable to receive commands from a human operator.

The tool string 110 may comprise an uphole or upper portion 140, a downhole or lower portion 160, and an intermediate portion 150 coupled between the upper portion 140 and the lower portion 160. The portions 140, 150, 160 of the tool string 110 may each be or comprise one or more downhole tools, modules, and/or other apparatus operable in wireline, while-drilling, coiled tubing, completion, production, and/or other implementations. Each portion 140, 150, 160 of the tool string 110 may comprise at least one corresponding electrical and/or optical conductor 145, 155, 165 in communication with at least one component of the surface equipment 175. Each of the conductors 145, 155, 165 may comprise a plurality of individual conductors, such as may facilitate communication between one or more of the tool string portions 140, 150, 160 and one or more component of the surface equipment 175, such as the power and control system 172. Thus, the conductors 145, 155, 165 may connect with and/or form a portion of the conveyance means 171, and may include various electrical and/or optical connectors or interfaces along such path. Furthermore, the conductors 145, 155, 165 may facilitate communication between two or more of the tool string portions 140, 150, 160. Each portion 140, 160, 150 may comprise one or more electrical and/or optical connectors (not shown), such as may be operable to electrically and/or optically connect the conductors 145, 155, 165 extending therebetween. For example, the conveyance means 171 and the conductors 145, 155, 165 may be operable to transmit and/or receive electrical power, data, and/or control signals between the power and control system 172 and one or more of the portions 140, 150, 160.

Each portion 140, 150, 160 of the tool string 110 may be or comprise one or more downhole tools, subs, modules, and/or other apparatuses operable in wireline, while-drilling, coiled tubing, completion, production, and/or other operations. Although the tool string 110 is shown comprising three portions 140, 150, 160, it is to be understood that the tool string 110 may comprise additional portions. For example, the portions 140, 150, 160 may each be or comprise one or more of a cable head, a telemetry tool, a directional tool, an acoustic tool, a density tool, an electromagnetic (EM) tool, a formation evaluation tool, a gravity tool, a formation logging tool, a magnetic resonance tool, a formation measurement tool, a monitoring tool, a neutron tool, a nuclear tool, a photoelectric factor tool, a porosity tool, a reservoir characterization tool, a resistivity tool, a seismic tool, a surveying tool, a release tool, a mechanical interface tool, an anchor tool, a perforating tool, a cutting tool, a linear actuator, a rotary actuator, a downhole tractor, a jarring tool, an impact or impulse tool, a vibrating or shaking tool, a fishing tool, a valve key or engagement tool, and a plug setting tool.

One or more of the portions 140, 150, 160 may be or comprise inclination sensors and/or other position sensors, such as one or more accelerometers, magnetometers, gyroscopic sensors (e.g., micro-electro-mechanical system (MEMS) gyros), and/or other sensors for utilization in determining the orientation of the tool string 110 relative to the wellbore 120. Furthermore, one or more of the portions 140, 150, 160 may be or comprise a correlation tool, such as a casing collar locator (CCL) operable to detect ends of casing collars by sensing a magnetic irregularity caused by a relatively high mass of an end of a collar of the casing 124. The correlation tool may also or instead be or comprise a gamma ray (GR) tool that may be utilized for depth correlation. The CCL and/or GR tools may transmit signals in real-time to the wellsite surface equipment 175, such as the power and control system 172, via the conveyance means 171. The CCL and/or GR signals may be utilized to determine the position of the tool string 110 or portions thereof, such as with respect to known casing collar numbers and/or positions within the wellbore 120. Therefore, the CCL and/or GR tools may be utilized to detect and/or log the location of the tool string 110 within the wellbore 120, such as during deployment within the wellbore 120 or other downhole operations.

Figure 2:
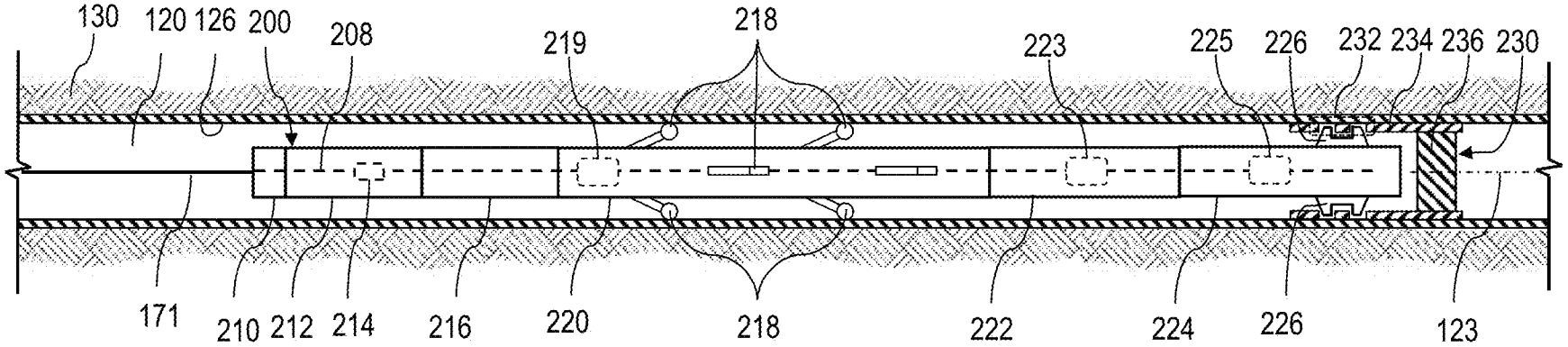
FIG. 2 is a schematic view of at least a portion of an example implementation of apparatus according to one or more aspects of the present disclosure.

FIG. 2 is a schematic view of an example implementation of the tool string 110 shown in FIG. 1 according to one or more aspects of the present disclosure, designated in FIG. 2 by numeral 200. The tool string 200 is shown disposed within the substantially horizontal portion 121 of the wellbore 120 and connected with the surface equipment 175 via the conveyance means 171. However, it is to be understood that the tool string 200 may also be utilized within a substantially vertical or otherwise deviated portion of the wellbore 120. The following description refers to FIGS. 1 and 2, collectively.

The tool string 200 comprises a plurality of modules communicatively connected with each other and the wellsite equipment 175 via an electrical and/or optical conductor system 208 extending through the modules of the tool string 200. Although not shown, it is to be understood that the tool string 200 may comprise one or more bores extending longitudinally through the various components of the tool string 200 to accommodate the conductor system 208. The tool string 200 may comprise a cable head 210 operable to connect the conveyance means 171 with the tool string 200. The tool string 200 may further comprise a control module 212 downhole from the cable head 210. The control module 212 may comprise a controller 214 communicatively coupled with one or more portions and/or components of the tool string 200 via the conductor system 208, and with the power and control system 172 via the conveyance means 171.

The controllers 178, 214 may be independently or cooperatively operable to control operations of one or more portions and/or components of the tool string 200. For example, the controllers 178, 214 may be operable to receive and process signals obtained from various sensors of the tool string 200, store the processed signals, operate one or more portions and/or components of the tool string 200 based on the processed signals, and/or communicate the processed signals to the power and control system 172 or another component of the surface equipment 175. The controller 214 may be operable to receive control commands from the power and control system 172 for controlling one or more portions and/or components of the tool string 200. The control module 212 may also comprise the correlation and telemetry tools, such as may facilitate positioning of the tool string 200 along the wellbore 120 and communication with the surface equipment 175.

The tool string 200 may further comprise one or more actuator modules 220, 222, an engagement device 224, and a power module 216 operable to provide power to operate the actuator modules 220, 222, the engagement device 224, and/or one or more other modules and/or portions of the tool string 200. The actuator modules 220, 222 may be operable to generate and/or apply corresponding forces to an operatable or movable member 234 of a downhole apparatus 230 installed within the wellbore 120, via the engagement device 224, to move or otherwise operate the downhole apparatus 230.

The engagement device 224 may comprise engagement members 226 operable to connect, interface, or otherwise engage with a downhole feature 232 of the movable member 234 of the downhole apparatus 230. The movable member 234 may be operatively connected with a fluid control or obstructing member 236 of the downhole apparatus 230, and configured to operate the fluid obstructing member 236 when mechanically moved or actuated. For example, the downhole apparatus 230 may be a fluid valve assembly, such as an isolation valve, a flow control valve, a safety valve, a flapper valve, a ball valve, a gas-lift valve, a plug, or a packer, and the movable member 234 may be or comprise a sliding sleeve, a mandrel, or a bracket, configured to mechanically shift or operate the fluid obstructing member 236 of the downhole apparatus 230. The downhole feature 232 located on the movable member 234 may be or comprise one or more grooves, notches, shoulders, or another profile of the movable member 234. The engagement device 224 may be or comprise a setting tool or a shifting tool comprising one or more of the engagement members 226, which may be operable to extend outwardly from and retract into the engagement device 224 to engage with and disengage from the downhole feature 232 of the downhole apparatus 230. The engagement members 226 may be operatively connected with and actuated by one or more actuators 225 operable to extend and retract the engagement members 226. The actuators 225 may be or comprise, for example, hydraulic rams, hydraulic motors, linear electric motors, and rotary electric motors. Accordingly, when the tool string 200 is conveyed along the wellbore 120 such that the engagement members 226 are adjacent the downhole features 232 of the downhole apparatus 230 that is stuck or intended to be actuated, the engagement device 224 may be operated to extend the engagement members 226 to engage with the downhole feature 232 to connect the engagement device 224 with the movable member 234.

The engagement members 226 may include keys, grooves, or another profile operable to connect, interface, or otherwise engage with the corresponding downhole feature 232. The engagement device 224 may further comprise a fishing tool or another tool operable to connect, interface, or otherwise engage with the downhole apparatus 230. Accordingly, the actuator modules 220, 222 may be operable to impart the corresponding forces to the downhole apparatus 230 via the engagement device 224, when engaged with the downhole feature 232 of the downhole apparatus 230, to actuate, move, operate, or dislodge the downhole apparatus 230. Although the engagement members 226 are described as being operable to both extend and retract, it is to be understood that the engagement members 226 may be or comprise "one-shot" engagement members, operable to extend, but not retract. To disengage such engagement members from the downhole feature 232, the engagement members may be broken or snapped off.

The actuator module 220 may be operable to axially move at least a portion of the tool string 200, including the actuator module 222 and the engagement device 224, along a longitudinal axis 123 of the wellbore 120. To facilitate such movement, the actuator module 220 may be operable to generate or apply a substantially non-vibrating axial force to the actuator module 222 and engagement device 224 to move or operate the downhole apparatus 230 while the engagement member 226 is engaged with the downhole feature 232.

The actuator module 220 may apply the substantially non-vibrating axial force to the downhole apparatus 230 in the form of compression, such as when the actuator module 220 increases or moves in the downhole direction against the downhole apparatus 230. The actuator module 220 may also or instead apply the substantially non-vibrating axial force to the downhole apparatus 230 in the form of tension, such as when the actuator module 220 decreases in length or moves in the uphole direction away from the downhole apparatus 230.

In an example implementation, the actuator module 220 may be a downhole tractor comprising a plurality of tractor drives 218 movable outwardly against the sidewall 126 to grip the sidewall 126. The tractor drives 218 may rotate while in contact with the sidewall 126 to move the downhole tractor and, thus, the tool string 200 in an intended uphole or downhole direction along the wellbore 120 to apply the substantially non-vibrating axial force to the downhole apparatus 230 engaged with the engagement device 224. The tractor drives 218 may be operatively connected with and actuated by one or more actuators 219 operable to extend and rotate the tractor drives 218. The actuators 219 may be or comprise, for example, hydraulic rams, hydraulic motors, linear electric motors, and/or rotary electric motors. Accordingly, when the engagement members 226 are engaged with the movable member 234 of the downhole apparatus 230, the tractor drives 218 of the actuator module 220 may be operated to move the engagement device 224 axially in the uphole or downhole direction to operate or move the downhole apparatus 230 as intended. Other types of downhole tractors may also be utilized within the scope of the present disclosure. For example, a downhole tractor utilizing an inchworm principle with two or more sections alternatingly gripping the sidewall 126 and resetting may also be utilized to move the tool string 200 in an intended direction along the wellbore 120.

The actuator module 222 may be employed within the tool string 200 to perform or assist in the performance of well intervention operations or other downhole operations. The actuator module 222 may be coupled between the actuator module 220 and the engagement device 224, such as may permit the actuator module 222 to augment, supplement, or modify the substantially non-vibrating axial force generated by the actuator module 220 and applied to the downhole apparatus 230 via the engagement device 224. The actuator module 222 may be operable to generate or apply a force to the engagement device in the form of frequency-controlled impulse loads, such as a fluctuating, reciprocating, oscillating, or otherwise vibrating force. Accordingly, the actuator module 222 may be operable to apply the vibrating force to the engagement device 224 and, thus, the downhole apparatus 230, to move or operate the movable member 234 of the downhole apparatus 230.

One or more actuators 223 of the actuator module 222 may generate the vibrating force. The actuators 223 may be or comprise hydraulic rams, hydraulic motors, electric motors (linear and/or rotary), and/or other types of actuators. The vibrating force may be an axially vibrating force directed substantially parallel to the longitudinal axis 123 of the wellbore 120. The vibrating force may instead or also be a radially vibrating force directed in a radial direction substantially perpendicular to the wellbore axis 123. The vibrating force may instead or also be a rotationally vibrating force directed rotationally around the wellbore axis 123.

The actuator module 222 may be coupled between the actuator module 220 and the engagement device 224. Thus, the actuator module 220 may be operable to apply the substantially non-vibrating axial force to the actuator module 222, such that the actuator module 222 may be operable to apply a combination of the substantially non-vibrating and vibrating forces to the engagement device 224.

During operations, the actuator module 220 may be operated before the actuator module 222 to operate or move the downhole apparatus 230. If the actuator module 220 by itself is unable to or does not operate to move the downhole apparatus, the actuator module 222 may be operated in conjunction with the actuator module 220. While operating both actuator modules 220, 222, the substantially non-vibrating force generated by the actuator module 220 and the vibrating force generated by the actuator module 222 may be simultaneously imparted to the downhole apparatus 230, via the engagement device 224, to collectively move the movable member 234 (and, thus, downhole feature 232) between intended positions. Such movement may be to actuate, move, operate, or dislodge the downhole apparatus 230.

The power module 216 may be operable to provide power to operate the actuator modules 220, 222, the engagement device 224, and/or one or more other modules and/or portions of the tool string 200. For example, the power module 216 may be or comprise a hydraulic power pack, which may be operable to supply hydraulic power to the actuator modules 220, 222 and the engagement device 224. The hydraulic power pack may provide a pressurized fluid to the one or more actuators 219 of the actuator module 220 to extend and rotate the drives 218, such as may facilitate movement of the actuator module 220 along the wellbore 120. The hydraulic power pack may further provide the pressurized fluid to the one or more actuators 223 of the actuator module 222 to generate the vibrating force. The hydraulic power pack may also provide the pressurized fluid to the one or more actuators 225 of the engagement device 224 to outwardly extend the engagement members 226 against the downhole feature 232 of the downhole apparatus 230.

The power module 216 may also or instead be or comprise an electrical power source, such as a battery. In such implementations, the battery may provide electrical power to the actuators 219, 223, 225 to operate the actuator modules 220, 222 and the engagement device 224 as described above. The power module 216 may also be omitted from the tool string 200, such as in implementations in which hydraulic and/or electrical power may be provided from the wellsite surface 105 via the conveyance means 171.

Figure 3:
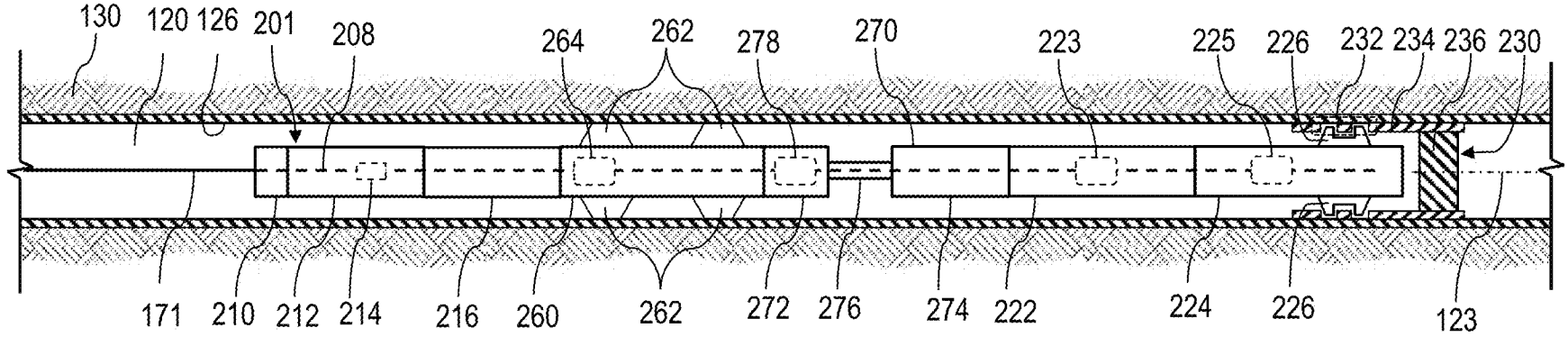
FIG. 3 is a schematic view of at least a portion of an example implementation of apparatus according to one or more aspects of the present disclosure.

FIG. 3 is a schematic view of an example implementation of the tool string 110 shown in FIG. 1 according to one or more aspects of the present disclosure, and designated in FIG. 3 by reference number 201. The tool string 201 comprises one or more similar features of the tool string 200 shown in FIG. 2, including where indicated by like reference numbers, except as described below. Similarly as in FIG. 2, the tool string 201 is shown disposed within the substantially horizontal portion 121 of the wellbore 120 and connected with the surface equipment 175 via the conveyance means 171. However, it is to be understood that the tool string 201 may also be utilized within a substantially vertical or otherwise deviated portion of the wellbore 120. The following description refers to FIGS. 1, 2, and 3, collectively.

The substantially non-vibrating force applied to the engagement device 224 may be generated by means other than the actuator module 220 of the tool string 200. For example, instead of or in addition to the actuator module 220, the tool string 201 may comprise an actuator module 260 operable to anchor the tool string 201 against the sidewall 126 of the casing 124, and an actuator module 270 operable to impart the substantially non-vibrating force to the engagement device 224.

The actuator module 260 may comprise gripping members 262 located on opposing sides of the actuator module 260. The gripping members 262 may be operable to extend outwardly against the sidewall 126 to grip the casing 124 to lock or maintain at least a portion of the tool string 201 in a fixed position within the wellbore 120. The actuator module 260 may comprise one or more actuators 264 operable to extend and retract the gripping members 262 into and from engagement with the sidewall 126. The actuator 264 may be implemented as a hydraulic ram or motor, an electric actuator or motor, and/or other actuators.

The actuator module 270 may be or comprise a linear actuator, such as a ram or stroker tool. The actuator module 270 may comprise a static portion 272 connected with a movable portion 274 via an intermediate shaft 276. The movable portion 274 may be operable to move axially with or about the shaft 276 substantially parallel to the wellbore axis 123 to impart the substantially non-vibrating axial force to the engagement device 224. The actuator module 270 may comprise one or more actuators 278 operable to actuate the axial movement of the movable portion 274. For example, the actuator 278 may be a hydraulic pump operable to pressurize hydraulic fluid to power the actuator module 270. The actuator 264 may also be implemented as an electric linear actuator or motor operable to impart movement to the shaft 276 and/or the movable portion 274. Accordingly, when the engagement members 226 are engaged with the movable member 234 of the downhole apparatus 230, the gripping members 262 of the actuator module 260 may be operated to lock the static portion 272 of the actuator module 270 in position, and then the actuator module 260 may be operated to move the movable portion 274 and the engagement device 224 axially in the uphole or downhole direction to operate or move the downhole apparatus 230 as intended.

Similarly to as described above with respect to the tool string 200, the power module 216 may be operable to provide power to operate the actuator modules 260, 270, 222, the engagement device 224, and/or one or more other modules and/or portions of the tool string 201. For example, when implemented as a hydraulic power pack, the power module 216 may be operable to supply hydraulic power to the actuators 264, 278, 223, 225 to operate the actuator modules 260, 270, 222 and the engagement device 224, as described above. When implemented as an electrical power source, the power module 216 may be operable to supply electrical power to the actuators 264, 278, 223, 225 to operate the actuator modules 260, 270, 222 and the engagement device 224, as described above. The power module 216 may also be omitted from the tool string 201, such as in implementations in which hydraulic or electrical power may be provided from the wellsite surface 105 via the conveyance means 171.

Figure 4:
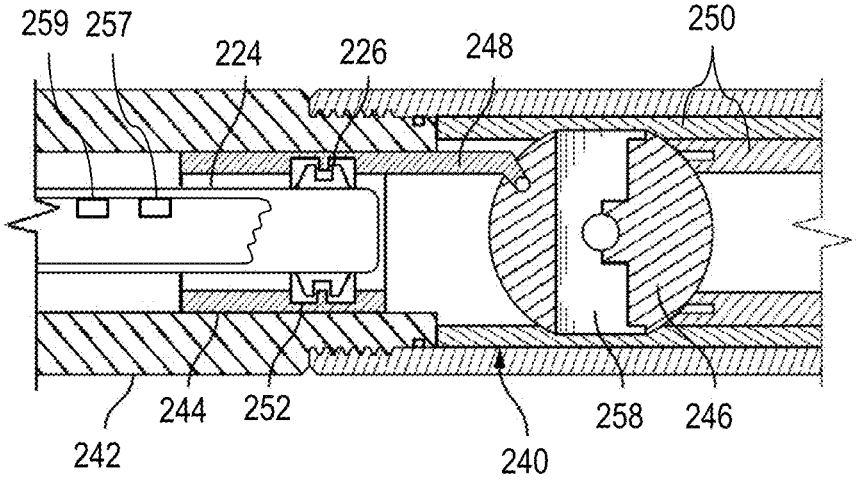
FIG. 4 is a sectional view of a portion of the apparatuses shown in FIGS. 2 and 3 according to one or more aspects of the present disclosure.
Figure 5:
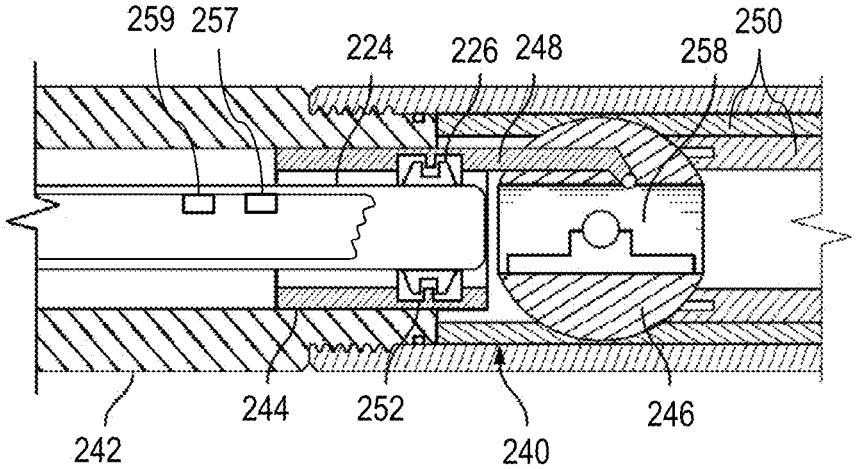
FIG. 5 is a sectional view of the apparatus shown in FIG. 4 in a different stage of operation.

FIGS. 4 and 5 are schematic views of at least a portion of an example implementation of the downhole apparatus 230 and the engagement device 224 shown in FIGS. 2 and 3 and at different stages of operation. The following description refers to FIGS. 1-5, collectively.

FIGS. 4 and 5 show the downhole apparatus 230 implemented as a downhole valve assembly 240 disposed within a downhole tubular assembly 242 and operable to shut off or otherwise limit fluid flow through the tubulars 242. The valve assembly 240 comprises a movable sleeve 244 operatively connected with a ball member 246 via a bracket 248 pivotally connected with the ball member 246. The ball member 246 is maintained in position by packing members 250 of the downhole valve assembly 240. The movable sleeve 244 includes a downhole feature 252 comprising a groove and a protrusion receiving, accommodating, or otherwise engaging with the engagement members 226 of the engagement device 224. The ball member 246 comprises a bore 258 or fluid pathway extending therethrough, and may be operated or rotated to selectively permit, prevent, or otherwise limit fluid flow through the valve assembly 240 via operation or movement of the movable sleeve 244. FIG. 4 shows the movable sleeve 244 in a first or initial position and the ball member 246 in a closed-flow position, while FIG. 5 shows the movable sleeve 244 in a second or final position and the ball member 246 in an open-flow position. Accordingly, to operate the valve assembly 240 to the open-flow position, the engagement device 224 may be moved in the downhole direction from the initial position to the final position, and to operate the valve assembly 240 to the closed-flow position, the engagement device 224 may be moved in the uphole direction from the final position to the initial position.

As further shown in FIGS. 4 and 5, the engagement device 224 or another portion of the tool string 110 may include an accelerometer 257, which may be operable to generate a signal or information indicative of acceleration, shock, and/or forces imparted to the engagement device 224. The signal generated by the accelerometer 257 may be communicated to the controllers 178, 214 and utilized to monitor the acceleration, mechanical shock, and/or forces imparted to the movable sleeve 244 by the actuator modules 220, 270, 222 during operations. The accelerometer 257 may comprise a one, two, or three-axis accelerometer operable to measure axial and/or lateral acceleration and deceleration of the engagement device 224. Implementations within the scope of the present disclosure may also comprise multiple instances of the accelerometer 257, including implementations in which each accelerometer 257 may detect a different range of acceleration. The accelerometer 257 may be mounted to a wall or housing of the engagement device 224.

The engagement device 224 or another portion of the tool string 110 may also include a load cell 259, which may be operable to generate a signal or information indicative of the forces imparted to the engagement device 224. The signal generated by the load cell 259 may be communicated to the controllers 178, 214 and utilized to monitor the force imparted to the movable sleeve 244 by the actuator modules 220, 222, 260 during operations. Implementations within the scope of the present disclosure may also comprise multiple instances of the load cell 259, such as may be operable to measure axial forces, radial forces, and/or rotational forces or torque imparted to the movable sleeve 244. The load cell 259 may be or comprise a Wheatstone bridge strain gauge. The load cell 259 may be mounted to the wall or housing of the engagement device 224.

During certain downhole applications of the wellsite system 100, increasing the substantially non-vibrating axial force applied by the tensioning device 170 or the actuator modules 220, 270 may not be sufficient to actuate, move, operate, or dislodge the downhole apparatus 230 or may be detrimental to the downhole apparatus 230 or the tool string 200, 201. For example, material buildup or contaminants, such as rock particles, sand, proppants, or other debris, may seize portions of the downhole apparatus 230, such as the movable member 234, wherein applying an increasing amount of the substantially non-vibrating axial force to the downhole apparatus 230 may cause material fatigue or damage to portions of the downhole apparatus 230 or the tool string 200, 201.

For example, debris may become lodged between the movable sleeve 244 and the tubing assembly 242, between the ball member 246 and the packing members 250, and/or between other movable portions of the valve assembly 240 to increase frictional forces between such movable portions. Simply increasing the substantially non-vibrating axial force applied to the movable sleeve 244 via the engagement device 224 may exacerbate the problem by further jamming or seizing the movable sleeve 244 against the tubing assembly 242 and/or seizing the ball member 246 against the packing members 250. Increasing the substantially non-vibrating axial force may also damage portions of the valve assembly 240, such as the bracket 248 connecting the ball member 246 and the movable sleeve 244. By applying the axially, radially, and/or rotationally vibrating forces in conjunction with the substantially non-vibrating axial force, the debris and/or material buildup may be loosened, broken up, or dispersed away from the movable sleeve 244, the ball member 246, and/or other movable members of the valve assembly 240 to free the movable sleeve 244, the ball member 246, and/or other movable members of the valve assembly 240, permitting the substantially non-vibrating axial force to operate or move the valve assembly 240. The vibrating force may further assist in overcoming static friction of the movable members, such as caused by the material buildup. Accordingly, the combination of the substantially non-vibrating axial force and vibrating force may permit use of a relatively low or substantially lower non-vibrating axial force to operate the valve assembly 240 compared to the magnitude of the non-vibrating axial force utilized when no vibrating force is applied. Accordingly, use of lower non-vibrating axial force in conjunction with the vibrating force may decrease the chances of damaging or seizing the valve assembly 240.

Figure 6:
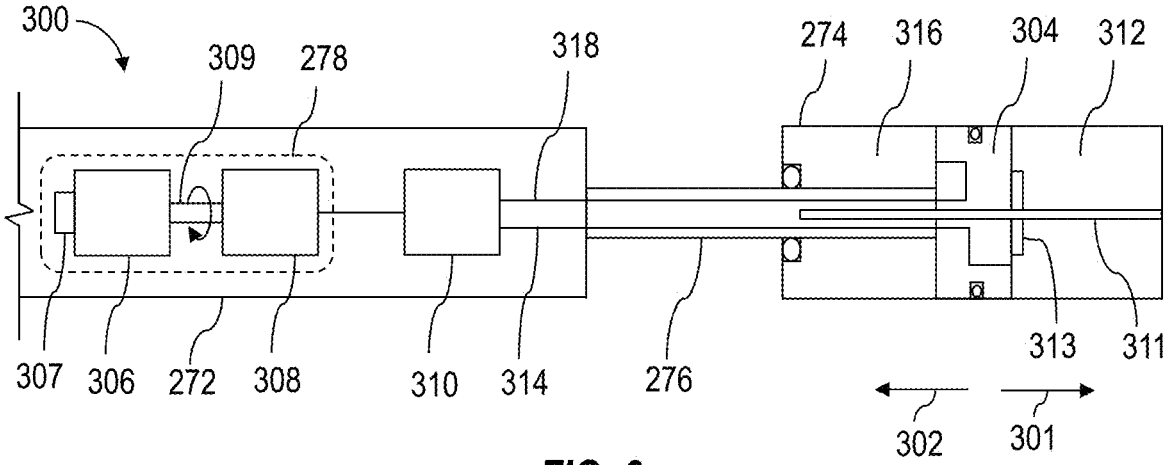
FIG. 6 is a schematic view of a portion of an example implementation of the apparatus shown in FIG. 3 according to one or more aspects of the present disclosure.

FIG. 6 is a schematic view of a portion of an example implementation of the actuator module 270 of the tool string 201 shown in FIG. 3, designated in FIG. 6 by numeral 300, and operable to generate or apply the substantially non-vibrating axial force according to one or more aspects of the present disclosure. The actuator module 300 comprises one or more similar features of the actuator module 270, including where indicated by like reference numbers, except as described below. The following description refers to FIGS. 3 and 6, collectively.

The actuator module 300 may comprise the static portion 272 connected to the movable portion 274 via the intermediate shaft 276. The movable portion 274 may be operable to move axially, as indicated by arrows 301, 302, about the shaft 276 and a cylinder 304 connected with the shaft 276 to impart the substantially non-vibrating force to the engagement device 224. The actuator module 300 is further shown comprising the actuator 278 operable to cause the axial movement of the movable portion 274. The actuator 278 is shown implemented as an assembly comprising an electrical motor 306 connected with and operable to rotate a hydraulic pump 308 via a drive shaft 309 to pressurize hydraulic fluid. When powered by electrical power received from the power module 216 or the wellsite surface 105, the motor 306 may actuate the pump 308 to pressurize and discharge the hydraulic fluid through a fluid directional control valve 310. To move the movable portion 274 away from the static portion 272, as indicated by the arrow 301, the valve 310 may direct the hydraulic fluid into a rear volume 312 of the movable portion 274 via a fluid conduit 314 and evacuate the hydraulic fluid from a front volume 316 of the movable portion 274 via a fluid conduit 318. To move the movable portion 274 toward the static portion 272, as indicated by the arrow 302, the valve 310 may direct the hydraulic fluid into the front volume 316 of the movable portion 274 via a fluid conduit 318 and evacuate the hydraulic fluid from the rear volume 312 of the movable portion 274 via the fluid conduit 314.

The actuator module 300 may further comprise one or more rotary sensors 307 operable to generate a signal or information indicative of rotational position, rotational speed, and/or operating frequency of the motor 306. For example, the rotary sensor 307 may be operable to convert angular position or motion of the drive shaft 309 or another rotating portion of the motor 306 to an electrical signal indicative of pumping speed of the pump 308 and, thus, the axial velocity and/or position of the movable portion 274 of the actuator module 300. The rotary sensor 307 may be mounted in association with an external portion of the drive shaft 309 or other rotating members of the motor 306. The rotary sensor 307 may also or instead be mounted in association with the pump 308 to monitor rotational position and/or rotational speed of the pump 308. Although not shown in FIG. 2, the actuator module 220 may also comprise one or more rotary sensors 307 mounted in association with the actuator 219, such as may permit the monitoring of the operating speed of the actuator 219 and, thus, the position and/or velocity of the actuator module 220 along the wellbore 120. The rotary sensor 307 may be or comprise an encoder, a rotary potentiometer, a synchro, a resolver, and/or an RVDT, among other examples.

The actuator module 300 may also include motor power and/or control components, such as a variable speed or frequency drive (VFD) (not shown), which may be utilized to facilitate control of the motor 306 by the controllers 178, 214. The VFD may be connected with or otherwise in communication with the motor 306 and the controllers 178, 214 via electrical communication means. The VFD may receive control signals from the controllers 178, 214 and output corresponding electrical power to the motor 306 to control the speed and the torque output of the motor 306 and, thus, control the pumping speed and fluid flow rate of the pump 308, as well as the maximum pressure generated by the pump 308. Although the VFD may be located within the actuator module 300, the VFD may be located or disposed at a distance from the motor 306. For example, the VFD may be located within the power module 216 and/or the power and control system 172.

The actuator module 300 may further comprise one or more linear sensors 311 operable to generate a signal or information indicative of the axial position and/or velocity of the movable portion 274, such as to monitor the position and/or velocity of the engagement device 224 with respect to the static portion 272. The sensor 311 may be disposed in association with the movable portion 274 in a manner permitting sensing of the position and/or velocity of the movable portion 274. For example, the sensor 311 may be disposed through the piston 304 to monitor relative position and/or velocity of a magnet or another marker 313 carried with the piston 304. The sensor 311 may be or comprise a linear encoder, a linear potentiometer, a capacitive sensor, an inductive sensor, a magnetic sensor, a linear variable-differential transformer (LVDT), a proximity sensor, a Hall effect sensor, and/or a reed switch, among other examples.

The rotary and/or linear sensors 307, 311 may facilitate monitoring or recording by the controllers 178, 214 the speed and/or position of the movable member 234 of the downhole apparatus 230, such as to monitor the speed at which the downhole apparatus is being operated or whether the downhole apparatus 230 has been fully opened or closed. Accordingly, the actuator modules 220, 270 may be operated in real-time based on feedback or information generated by the rotary and linear sensors 307, 311.

Instead of or in addition to utilizing the actuator module 220 shown in FIG. 2 or the actuator module 270 shown in FIG. 3, the substantially non-vibrating axial force applied to the engagement device 224 may be generated or applied from the wellsite surface 105 by the tensioning device 170 via the conveyance means 171. However, when utilizing a wireline, a slickline, an e-line, the tool string 200, 201 may be limited to applying a tensile force in the uphole direction, as opposed to coiled tubing, drill pipe, and production tubing, which may be utilized to also apply a compressive force in the downhole direction. Accordingly, the when forces generated by the tensioning means are not sufficient to operate the downhole apparatus 230 or perform other operations, the actuator module 222 may be activated to introduce the vibrating force, such as may aid to operate or move the downhole apparatus 230 or perform other operations.

FIGS. 7-14 are schematic views of a portion of example implementations of the actuator module 222 of the tool strings 200, 201 shown in FIGS. 2 and 3 according to one or more aspects of the present disclosure. FIGS. 7-14 show one or more similar features of the actuator module 222 shown in FIGS. 2 and 3, including where indicated by like reference numbers, except as described below. The following description refers to FIGS. 2, 3, and 7-14, collectively.

Figure 7:
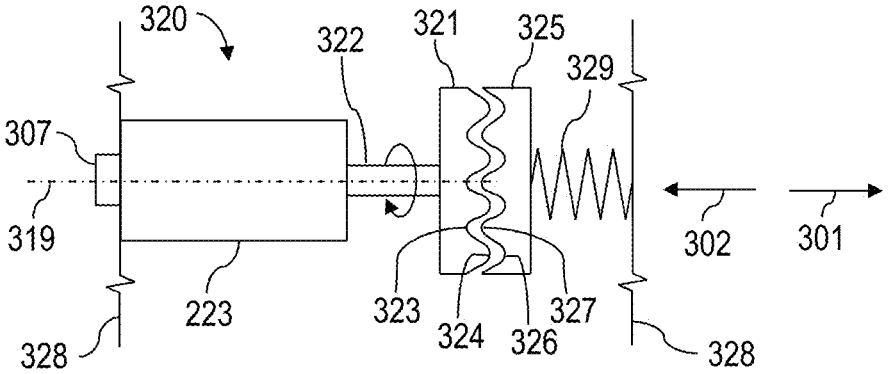
FIG. 7 is a schematic view of a portion of an example implementation of the apparatus shown in FIGS. 2 and 3 according to one or more aspects of the present disclosure.

FIG. 7 shows a portion of an example implementation of the actuator module 222, designated in FIG. 7 by numeral 320, operable to generate or apply the axially vibrating force according to one or more aspects of the present disclosure. The actuator module 320 may comprise the actuator 223, such as a hydraulic or electrical rotary actuator or motor, operatively connected with a rotor 321 via a shaft 322, such as may facilitate rotation of the rotor 321 about an axis of rotation 319. The rotor 321 may comprise a profile comprising alternating recesses or slots 323 and shoulders or protrusions 324. The rotor 321 may be aligned against a stator or contact member 325 such that the alternating slots 323 and protrusions 324 engage corresponding alternating slots 326 and protrusions 327 of the contact member 325. The contact member 325 may be connected with a body, chassis, or housing 328 of the actuator module 320 via a biasing member 329. During operations of the actuator module 320, as the actuator 223 is rotating the rotor 321, the alternating slots 323 and protrusions 324 of the rotor 321 may be operable to engage the corresponding alternating slots 326 and protrusions 327 of the contact member 325 to axially move the contact member 325 away from the actuator 223, as indicated by the arrow 301, and permit the biasing member 329 to move the contact member 325 toward the actuator 223, as indicated by arrow 302, resulting in the contact member 325 moving in a vibrating manner. The vibrating (i.e., inertial) forces imparted to the contact member 325 may be transmitted to the housing 328 of the actuator module 320 via the biasing member 329. Also, the axis of rotation 319 may substantially coincide with or extend parallel to the axis 123 of the wellbore 120, such that the axially vibrating force may be directed along or parallel to the axis 123 of the wellbore 120. The axially vibrating force may then be transferred to the engagement device 224 connected with the actuator module 320.

In an example implementation of the actuator module 320, the stator 321 and the contact member 325 may be or comprise complementary face type or crown gears and the alternating slots 323, 326 and protrusions 324, 327 may be or comprise teeth that are smooth and rounded to assist in slippage. The gear profiles, number of gears, and the spring constant of the biasing member 329 may be adjusted to control the vibrating force.

Figure 8:
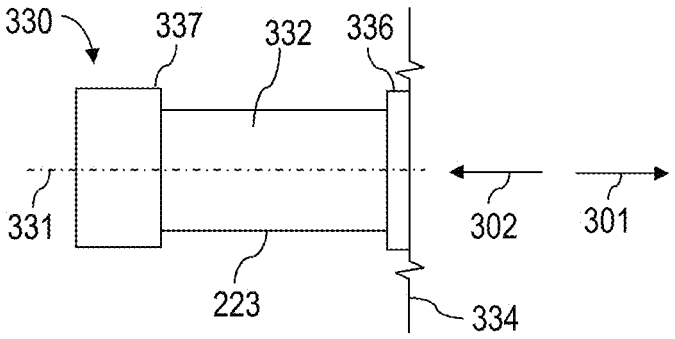
FIG. 8 is a schematic view of a portion of an example implementation of the apparatus shown in FIGS. 2 and 3 according to one or more aspects of the present disclosure.

FIG. 8 shows a portion of an example implementation of the actuator module 222, designated in FIG. 8 by numeral 330, operable to generate or apply the axially vibrating force according to one or more aspects of the present disclosure. The actuator module 330 may comprise the actuator 223, such as a piezoelectric actuator, comprising a piezoelectric element 332, such as a quartz crystal, operable to vibrate axially when an alternating electrical field is applied. One side of the piezoelectric element 332 may be fixedly connected with a body, chassis, or housing 334 of the actuator module 330 via a base 336 and an opposing side of the piezoelectric element 332 may be connected with a ballast member 337 comprising a predetermined mass. During operations, when the electric field is applied to a selected face of the piezoelectric element 332, a mechanical distortion of the piezoelectric element 332 occurs along an axis 331 generating a force to move the ballast member 337 along the axis 331. When the electric field is alternated or continuously turned on and off, the piezoelectric element 332 alternatingly extends and retracts to generate an alternating or vibrating force against the ballast member 337 to alternatingly extend and retract or vibrate the ballast member 337 along the axis 331, as indicates by arrows 301, 302. The vibrating (i.e., inertial) forces imparted to ballast member 337 may be transmitted to the housing 334 via the piezoelectric element 332 and then to the engagement device 224 connected with the actuator module 330. The axis 331 may substantially coincide with or extend parallel to the axis 123 of the wellbore 120, such that the vibrating force may be directed axially along or parallel to the axis 123 of the wellbore 120. The axis 331 may extend perpendicularly to the axis 123 of the wellbore 120, such that the vibrating force may be directed radially with respect to the axis 123 of the wellbore 120. The frequency of the vibrating force generated by the actuator module 330 may be adjusted by controlling the frequency at which the voltage is applied to the piezoelectric element 332.

Figure 9:
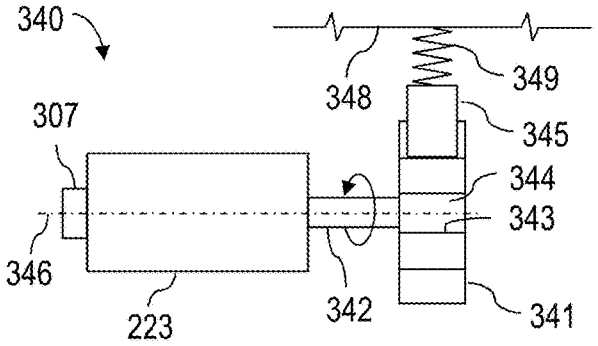
FIG. 9 is a schematic view of a portion of an example implementation of the apparatus shown in FIGS. 2 and 3 according to one or more aspects of the present disclosure.
Figure 10:
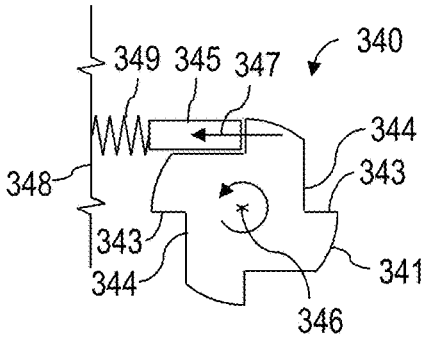
FIG. 10 is a schematic axial view of the apparatus shown in FIG. 9 according to one or more aspects of the present disclosure.

FIGS. 9 and 10 show top and axial views of a portion of an example implementation of the actuator module 222, designated in FIGS. 9 and 10 by numeral 340, operable to generate or apply the rotationally vibrating force according to one or more aspects of the present disclosure. The actuator module 340 may comprise the actuator 223, such as a hydraulic or electrical rotary actuator or motor, operatively connected with a gear or rotor 341 via a shaft 342, such as may facilitate rotation of the rotor 341 about an axis of rotation 346. The rotor 341 may have a profile comprising a plurality of alternating teeth, protrusions, or shoulders 343 and recesses or slots 344, such as may be operable to alternatingly engage and disengage one or more contact members 345 to move and release the contact member 345 along a vector perpendicular to and offset from the axis of rotation 346, as indicated by arrow 347. The contact member 325 may be connected with a body, chassis, or housing 348 of the actuator module 320 via a biasing member 349. During operations of the actuator module 340, as the actuator 223 is rotating the rotor 341, the shoulders 343 and the slots 345 may be operable to alternatingly push the contact member 345 toward the housing 348 of the actuator module 340, compressing the biasing member 349, and release the contact member 345, permitting the biasing member 349 to return the contact member 345 to its natural position. The vibrating (i.e., inertial) force imparted to the contact member 345 may be imparted to the housing 348 via the biasing member 349 along the vector perpendicular to and offset from the axis of rotation 346 or otherwise around the axis of rotation 346, as indicated by the arrow 347. The axis of rotation 346 may substantially coincide with or extend parallel to the axis 123 of the wellbore 120, such that the rotationally vibrating force may be directed around the axis 123 or tangentially with respect to the axis 123.

Figure 11:
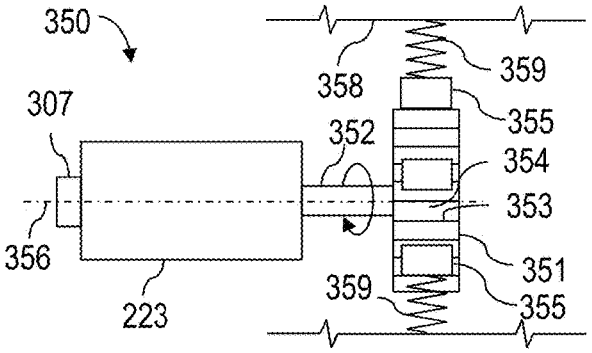
FIG. 11 is a schematic view of a portion of an example implementation of the apparatuses shown in FIGS. 2 and 3 according to one or more aspects of the present disclosure.
Figure 12:
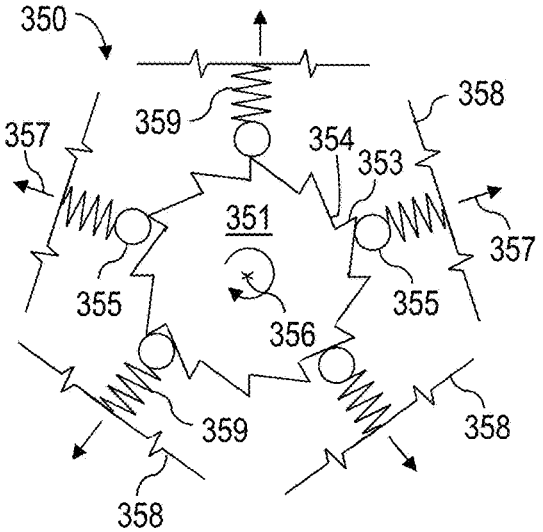
FIG. 12 is a schematic axial view of the apparatus shown in FIG. 11 according to one or more aspects of the present disclosure.

FIGS. 11 and 12 show side and axial views of a portion of an example implementation of the actuator module 222, designated in FIGS. 11 and 12 by numeral 350, operable to generate or apply the radially vibrating force according to one or more aspects of the present disclosure. The actuator module 350 may comprise the actuator 223, such as a hydraulic or electrical rotary actuator or motor, operatively connected with a gear or rotor 351 via a shaft 352, such as may facilitate rotation of the rotor 351 about an axis of rotation 356. The rotor 351 may have a profile comprising a plurality of alternating teeth, protrusions, or shoulders 353 and recesses or slots 354, such as may be operable to alternatingly engage and disengage a plurality of contact members 355 to move the contact members 355 along corresponding vectors extending radially or perpendicularly with respect to the axis of rotation 356, as indicated by arrows 357. The contact members 355 may be connected with a body, chassis, or housing 358 of the actuator module 350 via corresponding biasing members 359. During operations of the actuator module 350, as the actuator 223 is rotating the rotor 351, the shoulders 353 and the slots 355 may be operable to alternatingly push the contact members 355 toward the housing 358 of the actuator module 350, compressing the biasing members 359, and release the contact members 355, permitting the biasing members 359 to return the contact members 355 to their natural positions. The contacting members 355 and the shoulders 353 of the stator 351 may be configured such that each of the contact members 355 is movable radially at different times and in different radial directions with respect to the axis of rotation 356 during each vibration iteration or cycle as the stator 351 is rotated, as indicated by the arrows 357. The vibrating (i.e., inertial) force imparted to the contact members 355 may be imparted to the housing 358 via corresponding biasing members 359, as indicated by the arrows 357. The axis of rotation 356 may substantially coincide with or extend parallel to the axis 123 of the wellbore 120, such that the radially vibrating force may be directed in a plurality of radial directions with respect to the axis 123 of the wellbore 120.

Figure 13:
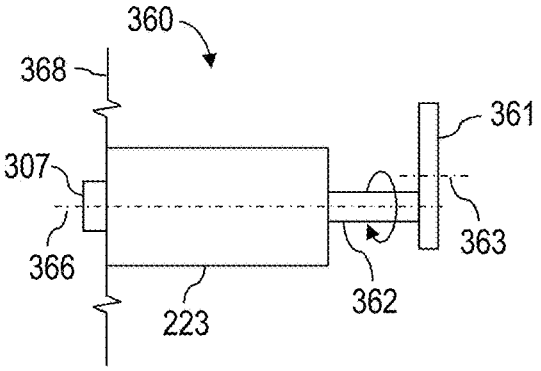
FIG. 13 is a schematic view of a portion of an example implementation of the apparatuses shown in FIGS. 2 and 3 according to one or more aspects of the present disclosure.
Figure 14:
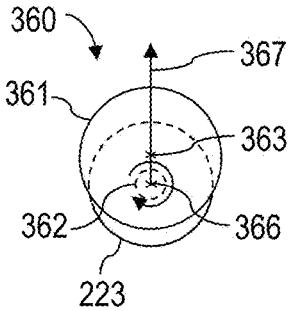
FIG. 14 is a schematic axial view of the apparatus shown in FIG. 13 according to one or more aspects of the present disclosure.

FIGS. 13 and 14 show side and axial views of a portion of an example implementation of the actuator module 222, designated in FIGS. 13 and 14 by numeral 360, operable to generate or apply the radially vibrating force according to one or more aspects of the present disclosure. The actuator module 360 may comprise the actuator 223, such as a hydraulic or electrical rotary actuator or motor, operatively connected with a rotor 361 via a shaft 362, such as may facilitate rotation of the rotor 361 about an axis of rotation 366. The actuator 223 may be fixedly connected with a body, chassis, or housing 368 of the actuator module 360. The rotor 351 may be asymmetrical, comprise an asymmetrical mass distribution, or may be connected with the shaft 362 at a point that is not the center of mass of the rotor 361. Accordingly, when rotated by the actuator 223, a centrifugal or rotating inertial force may be generated along a radial direction away from the axis of rotation 366, as indicated by an arrow 367. The radial force may be directed through a center of mass 363 of the rotor 361. Accordingly, the inertial force may continuously change direction as the center of mass 363 of the rotor 361 changes direction with the rotating rotor 361. The continuously changing inertial force may be transmitted to the actuator 223, causing the actuator 223 to vibrate radially 223 with respect to the axis of rotation 366. The radially vibrating force may then be transmitted to the housing 368 and the engagement device 224 connected with the actuator module 330. The axis of rotation 366 may substantially coincide with or extend parallel to the axis 123 of the wellbore 120, such that the radially vibrating force may be directed radially with respect to the axis 123 of the wellbore 120.

The speed of the actuators 223 of the actuator modules 320, 340, 350, 360 may be adjusted to control frequencies of the corresponding axial, rotational, and radial vibrations, which may be proportional to the rotational speed of the actuator 223. Accordingly, each of the actuator modules 320, 340, 350, 360 may further comprise one or more rotary sensors 307 operable to generate a signal or information indicative of rotational position, rotational speed, and/or operating frequency of the actuator 223. Both the rotary sensor 307 and the actuator 223 may be in communication with one or more of the controllers 178, 214, such as may permit the one or more of the controllers 178, 214 to control the rotational speed of the actuator 223. The actuators 223 of the actuator modules 320, 330, 340, 350, 360 may be operated to produce the vibrating forces at a relatively low frequency of about one hertz and up to a relatively high frequency of about 500 hertz or more.

Although the actuator modules 320, 330, 340, 350, 360 are shown as separate devices, it is to be understood that two or more of the actuator modules 320, 330, 340, 350, 360 may be incorporated as part of the actuator module 222 shown in FIGS. 2 and 3 within the scope of the present disclosure. Accordingly, the actuator module 222 may be operable to generate or apply two or more of the axially, rotationally, and radially vibrating forces to the engagement device 224 and the downhole apparatus 230. Furthermore, although the actuator module 222 is shown in FIGS. 2 and 3 as separate devices from the actuator modules 220, 270, it is to be understood that the actuator module 222 and the actuator modules 220, 270 may be incorporated into a single module within the scope of the present disclosure. Accordingly, combined actuator module may be operable to generate or apply the substantially non-vibrating axial force and one or more of the axially, rotationally, and radially vibrating forces to the engagement device 224 and the downhole apparatus 230.

Figure 15:
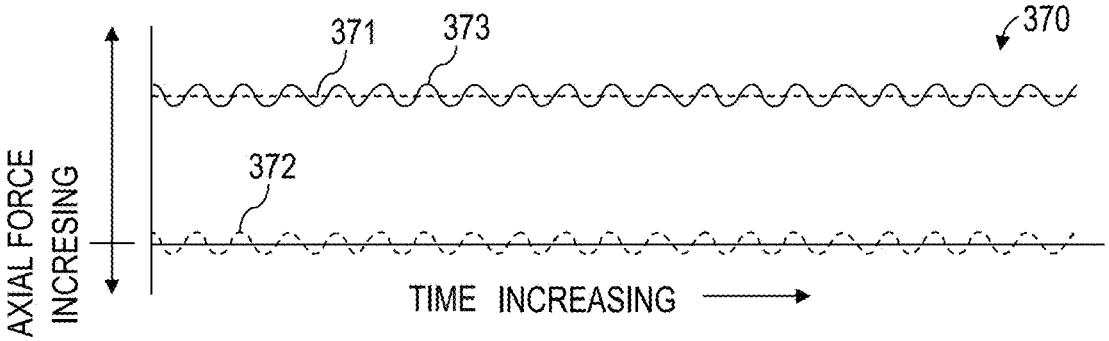
FIGS. 15-19 are graphs related to one or more aspects of the present disclosure.
Figure 16:
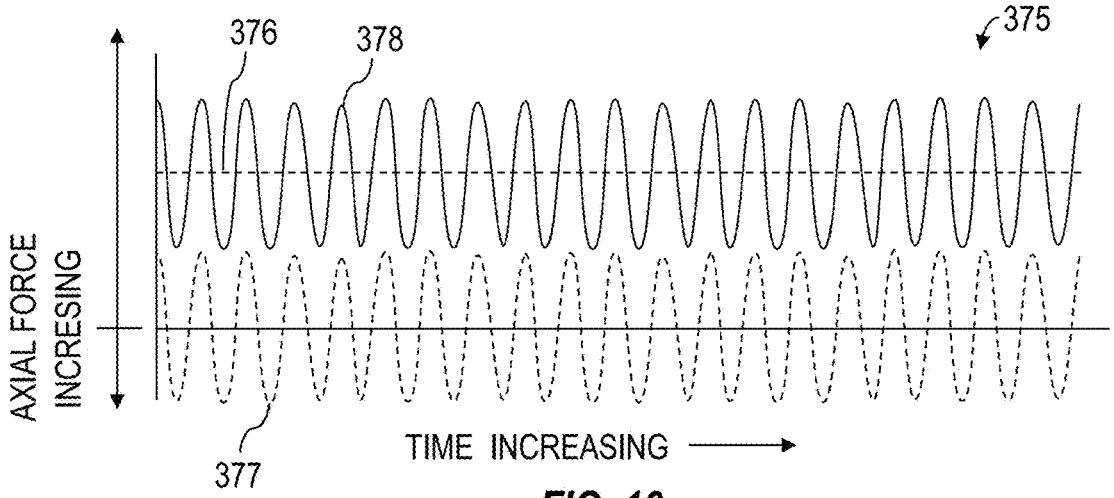
Figure 17:
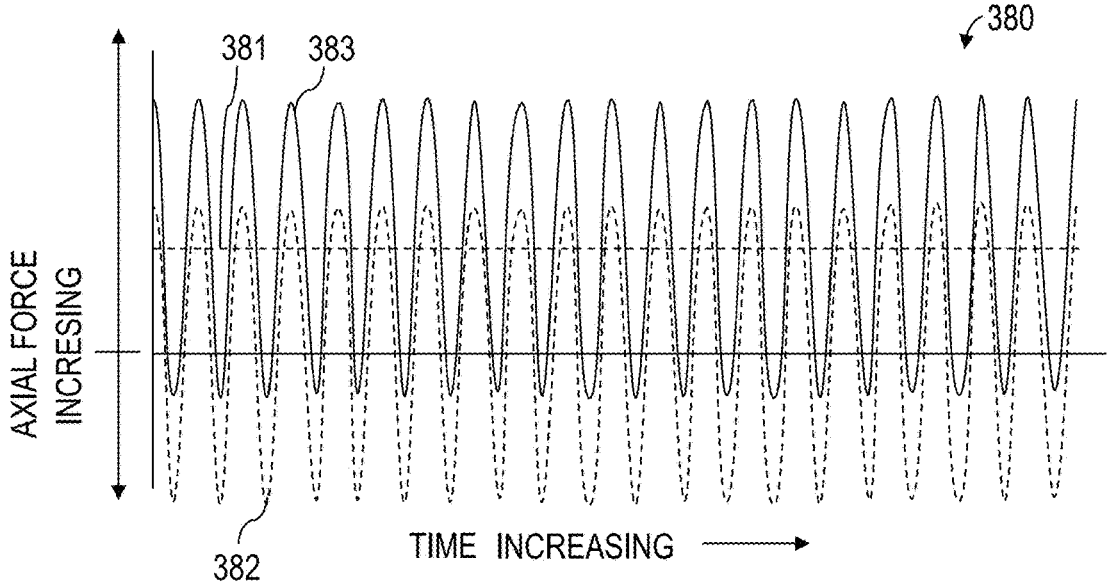

In addition to controlling the frequency of the vibrating forces, magnitude and direction of the substantially non-vibrating axial force and vibrating forces may also be controlled. FIGS. 15-17 are graphs showing example axial force profiles or curves representing the substantially non-vibrating axial force and the axially vibrating force generated by the actuator modules 220, 270, 222 shown in FIGS. 2 and 3 during operations. The graphs depict magnitude of the axial forces along the vertical axes, with respect to time, shown along the horizontal axes. The horizontal axes indicate a point at which the axial force is zero, such that curves or portions of the curves located on opposing sides of the horizontal axes indicate axial forces applied in opposing directions.

Graph 370 shows a curve 371 representing the substantially non-vibrating axial force generated or applied by the actuator module 220, 270 in one direction (i.e., uphole or downhole) and a curve 372 representing the axially vibrating force generated or applied by the actuator module 222 in opposing directions (i.e., uphole and downhole). The graph further shows a curve 373 representing a cumulative axial force applied to the engagement device 224, comprising both the substantially non-vibrating axial force 371 and the axially vibrating force 372. As the magnitude of the substantially non-vibrating axial force 371 is substantially greater that the magnitude of the axially vibrating force 372, the cumulative axial force 373 is shown continuously fluctuating on one side of the horizontal axis, indicating that the cumulative axial force 373 is applied to the downhole apparatus 230 in one direction (i.e., uphole or downhole) during operations.

Graph 375 shows a curve 376 representing the substantially non-vibrating axial force generated or applied by the actuator module 220, 270 in one direction and a curve 377 representing the axially vibrating force generated or applied by the actuator module 222 in opposing directions. The graph further shows a curve 378 representing a cumulative axial force applied to the engagement device 224, comprising both the substantially non-vibrating axial force 376 and the axially vibrating force 377. Although the axially vibrating force 377 is substantially larger than the axially vibrating force 372 shown in graph 370, the magnitude of the substantially non-vibrating axial force 376 is still greater that the magnitude of the axially vibrating force 377. Accordingly, the cumulative axial force 378 is shown continuously fluctuating on one side of the horizontal axis, indicating that the cumulative axial force 378 is applied to the downhole apparatus 230 in one direction during operations.

Graph 380 shows a curve 381 representing the substantially non-vibrating axial force generated or applied by the actuator module 220, 270 in one direction and a curve 382 representing the axially vibrating force generated or applied by the actuator module 222 in opposing directions. The graph further shows a curve 383 representing a cumulative axial force applied to the engagement device 224, comprising both the substantially non-vibrating axial force 381 and the axially vibrating force 382. Unlike the vibrating forces 372, 377 shown in graphs 370, 375, the magnitude of the axially vibrating force 382 is substantially greater that the magnitude of the non-vibrating axial force 381. Accordingly, the cumulative axial force 383 extends on both sides of the horizontal axis, indicating that the cumulative axial force 383 is continuously fluctuating in opposing axial directions (i.e., uphole and downhole) to apply the vibrating force to the downhole apparatus 230 in the opposing axial directions along the axis 123.

Figure 18:
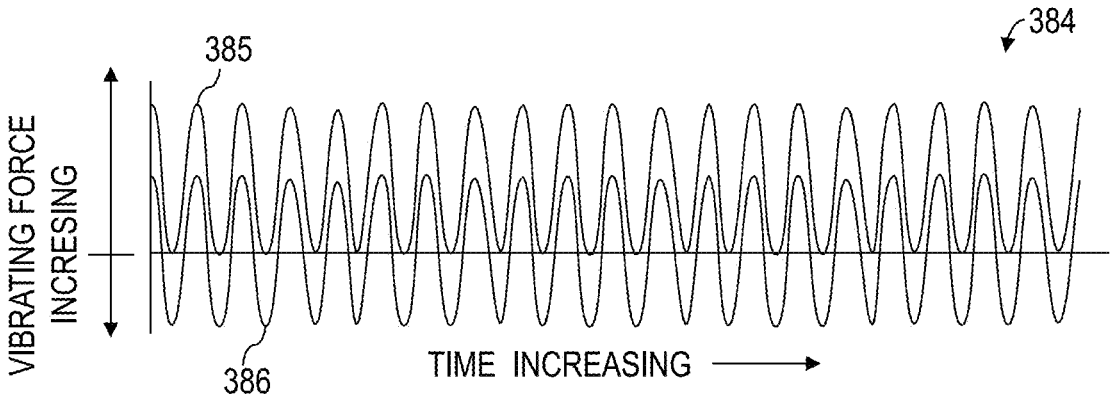

Magnitude and direction of the rotationally and radially vibrating forces may also be controlled. FIG. 18 is a graph 384 showing example rotationally and radially vibrating force profiles or curves generated by the actuator module 222 shown in FIGS. 2 and 3 during operations. The graph 384 shows the magnitude of the vibrating forces along a vertical axis, with respect to time, shown along a horizontal axis. The horizontal axis indicates a point at which the magnitude of the vibrating force is zero, such that curves or portions of the curves located on opposing sides of the horizontal axis indicate forces in opposing directions. The rotationally and radially vibrating forces may continuously vary or fluctuate in a single direction during operations, as shown by curve 385. For example, the radially vibrating force may be applied laterally in a single direction with respect to the wellbore axis 123 and the rotationally vibrating force may be applied in a single direction (i.e., clockwise or counter-clockwise) with respect to the wellbore axis 123. The rotationally and radially vibrating forces may continuously vary or fluctuate in opposing directions during operations, as shown by curve 386. For example, the radially vibrating force may be applied laterally in opposing directions with respect to the wellbore axis 123 and the rotationally vibrating force may be applied in opposing directions (i.e., clockwise and counter-clockwise) with respect to the wellbore axis 123.

The magnitude of the vibrating forces shown in FIGS. 15-18 may be controlled by various means. For example, controlling the rotating speed of the actuator 223 may control the force at which the rotors 321, 341, 351, 361 push or impact the contact members 325, 345, 355 to vary the inertial forces imparted to the contact members 325, 345, 355. Varying the mass of the contact members 325, 345, 355, the rotor 361, and the ballast member 337 may also vary the inertial forces imparted to the contact members 325, 345, 355, the rotor 361, and the ballast member 337. Varying the spring constant or stiffness of the biasing members 329, 349, 359 may vary the amount of the inertial forces transmitted from the contact members 325, 345, 355 to the corresponding housings 328, 348, 358. As described above, the continuously changing inertial forces imparted to portions of the actuator modules 320, 330, 340, 350, 360 may be transmitted to the corresponding housings 328, 334, 348, 358, 368 and to the engagement device 222 as vibrating forces. Accordingly, the magnitudes of the vibrating forces may be controlled by adjusting the magnitudes of the inertial forces.

Figure 19:
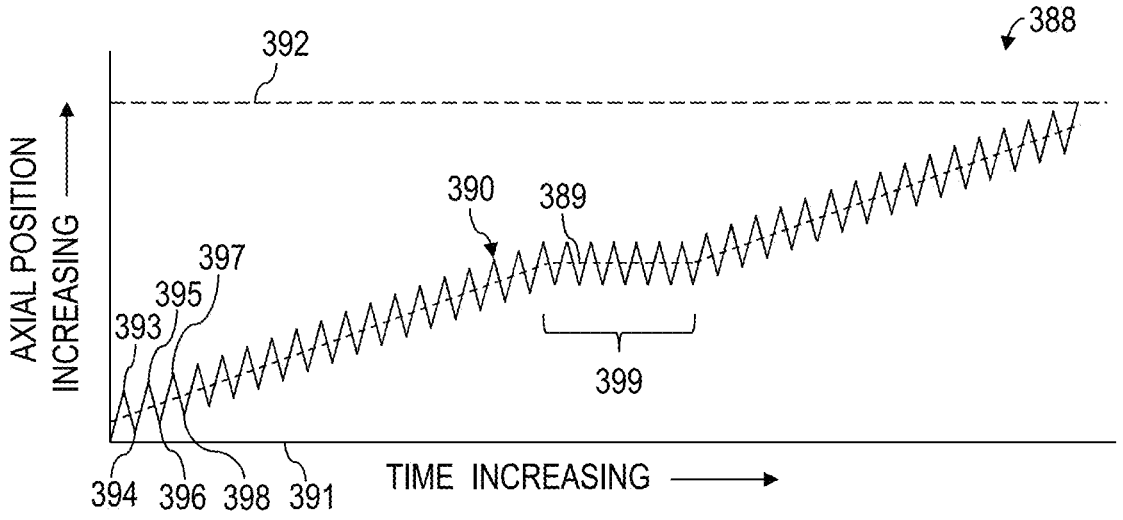

Although the substantially non-vibrating axial force is described above as being generated or applied by the actuator modules 220, 270 in a single direction, the actuator modules 220, 270 may also generate or apply the substantially non-vibrating axial force alternatingly in opposing directions to the engagement device 224. Such alternating axial force may be utilized in conjunction with or without the vibrating force generated or applied by the actuator module 222. FIG. 19 is a graph 388 showing an example profile or curve 390 indicative of an axial movement of the engagement member 226 or another portion of the engagement device 224 and, thus, movement of the movable member 234 of the downhole apparatus 230, while being actuated by the actuator modules 220, 270. The engagement device 224, the downhole apparatus 230, and the actuator modules 220, 270 are shown in FIGS. 2 and 3. Accordingly, the following description refers to FIGS. 2, 3, and 19, collectively.

The vertical axis of the graph 388 indicates axial position of the engagement member 226 and the movable member 234 connected with the engagement member 226 along the wellbore 120 and the horizontal axis 391 indicates time. The horizontal 391 axis also indicates a first or starting position of the downhole feature 232 or another portion of the movable member 234 when initially engaged by the engagement members 226, while a horizontal line 392 indicates a second or final position of the downhole feature 232 or another portion of the movable member 234. The distance between the first and second positions 391, 392 of the movable member 234 may be a distance sufficient to actuate or operate the downhole apparatus 230.

As the curve 390 indicates, the actuator modules 220, 270 may be operated to move the engagement device 224 and the engaged movable member 234 of the downhole apparatus 230 axially from the first position 391 to the second position 392 while also alternating the direction of movement of the movable member 234 in opposing axial directions. For example, the actuator modules 220, 270 may be operated to impart a force alternating in opposing axial directions (i.e., uphole and downhole) to the engagement device 224 to operate or move the downhole apparatus 230 alternatingly in opposing axial directions while the engagement members 226 are engaged with the downhole feature 232. Some of the alternating movements may be of different distances to achieve a net repositioning of the movable member 234 and the downhole feature 232 in one of the opposing axial directions (i.e., uphole or downhole) from the first position 391 to the second position 392. For example, each successive movement in a first axial direction (i.e., uphole or downhole) may move the movable member 234 and the downhole feature 232 closer to the second position 392 than resulted from a previous movement in the first axial direction, while successive movements in a second axial direction, opposite the first axial direction, may comprise substantially the same distance. The net repositioning of the movable member 234 and the downhole feature 232 may be an average movement of the alternating opposing axial movements of the movable member 234 and the downhole feature 232. The average movement is indicated by curve 389.

During example operations, the actuator modules 220, 270 may be operated to move the downhole feature 232 and the movable member 234 from the first position 391 to a third position 393 located between the first and second positions 391, 392 and then from the third position 393 to a fourth position 394 located between the first and third positions 391, 393. Thereafter, the downhole feature 232 and the movable member 234 may be moved from the fourth position 394 to a fifth position 395 located between the second and third positions 392, 393, then from the fifth position 395 to a sixth position 396 located between the fourth and fifth positions 394, 395, and then from the sixth position 396 to the second position 392. During example operations, the actuator modules 220, 270 may be operated to move the downhole feature 232 and the movable member 234 from the sixth position 396 to a seventh position 397 located between the second and fifth positions 392, 395, then from the seventh position 397 to an eighth 398 position located between the sixth and seventh positions 396, 397, and then from the eighth position 398 to the second position 392.

The frequency and the distance of each opposing movement may be adjustable by controlling the actuator modules 220, 270. For example, the actuator modules 220, 270 may be operable to alternate the movements between the opposing axial directions at a relatively low frequency of less than one hertz and up to a relatively high frequency of about 300 hertz or more. The actuator modules 220, 270 may be operable to move the engagement members 226 and the movable member 234 between about 0.025 millimeters (mm) (0.001 inch) and about 6.35 mm (0.25 inch) or more during each opposing movement. The speed, position, and/or distance traveled by the engagement members 226 and the downhole feature 232 may be monitored by the rotary sensor 307 associated with the actuator 219 of the actuator module 220 and the linear sensor 311 of the actuator module 270, as described above. Accordingly, the actuator modules 220, 270 may be operated in real-time based on feedback or information generated by the rotary and linear sensors 307, 311.

The actuator modules 220, 270 may also be operable to move the engagement members 226 and the movable member 234 based on friction forces or resistance to movement of the movable member 234. For example, if the resistance to movement of the movable member 234 is within a first (i.e., low) predetermined threshold range, the actuator modules 220, 270 may move the engagement members 226 and the movable member 234 from the first to the second position without alternating the direction of movement of the engagement members 226 and the movable member 234. If the resistance to movement of the movable member 234 is within a second (i.e., medium) predetermined threshold range, the actuator modules 220, 270 may move the engagement members 226 and the movable member 234 from the first to the second position while alternating the direction of movement of the engagement members 226 and the movable member 234, as described above. However, if the resistance to movement of the movable member 234 is within a third (i.e., high) predetermined threshold range, the actuator modules 220, 270 may alternate the direction of movement of the engagement members 226 and the movable member 234 without achieving the net repositioning of the engagement members 226 and the movable member 234 until the movable member 234 frees up or otherwise produces less resistance to movement, at which point the actuator modules 220, 270 may resume the net repositioning of the engagement members 226 and the movable member 234. A portion of the curves 390, 393 showing the actuator modules 220, 270 alternating the direction of movement of the engagement members 226 and the movable member 234 without achieving the net repositioning of the engagement members 226 and the movable member 234 is indicated by numeral 399. Accordingly, the actuator modules 220, 270 may be operated in real-time based on feedback or information generated by the accelerometers 257 and/or the load cells 259.

Figure 20:
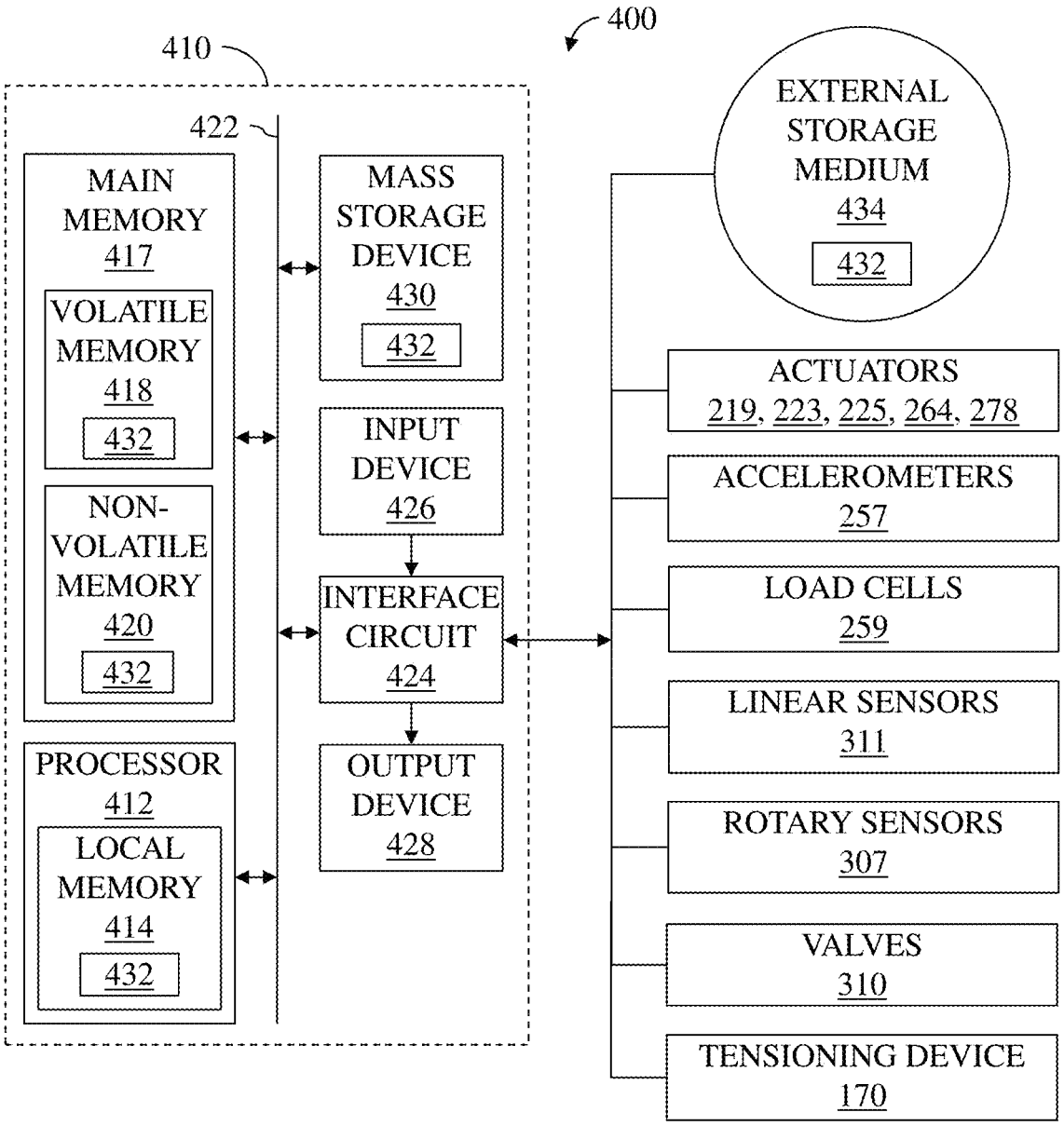
FIG. 20 is a schematic view of at least a portion of an example implementation of apparatus according to one or more aspects of the present disclosure.

Various portions of the apparatus described above and shown in FIGS. 1-14, may collectively form and/or be controlled by a control system, such as may be operable to monitor and/or control at least some operations of the wellsite system 100, including the tool string 200, 201. FIG. 20 is a schematic view of at least a portion of an example implementation of such a control system 400 according to one or more aspects of the present disclosure. The following description refers to one or more of FIGS. 1-20.

The control system 400 may comprise a controller 410, which may be in communication with various portions of the wellsite system 100, including the tensioning device 170, the actuators 219, 223, 225, 264, 278, the accelerometers 257, the load cells 259, the linear sensors 311, the rotary sensors 307, the valves 310, and/or other actuators and sensors of the tool string 200, 201. For clarity, these and other components in communication with the controller 410 will be collectively referred to hereinafter as "actuator and sensor equipment." The controller 410 may be operable to receive coded instructions 432 from the human operators and signals generated by the accelerometers 257, the load cells 259, the linear sensors 311, and the rotary sensors 307, process the coded instructions 432 and the signals, and communicate control signals to the actuators 219, 223, 225, 264, 278, the valves 310, and/or the tensioning device 170 to execute the coded instructions 432 to implement at least a portion of one or more example methods and/or processes described herein, and/or to implement at least a portion of one or more of the example systems described herein. The controller 410 may be or comprise one or more of the controllers 178, 214 described above.

The controller 410 may be or comprise, for example, one or more processors, special-purpose computing devices, servers, personal computers (e.g., desktop, laptop, and/or tablet computers) personal digital assistant (PDA) devices, smartphones, internet appliances, and/or other types of computing devices. The controller 410 may comprise a processor 412, such as a general-purpose programmable processor. The processor 412 may comprise a local memory 414, and may execute coded instructions 432 present in the local memory 414 and/or another memory device. The processor 412 may execute, among other things, the machine-readable coded instructions 432 and/or other instructions and/or programs to implement the example methods and/or processes described herein. The programs stored in the local memory 414 may include program instructions or computer program code that, when executed by an associated processor, facilitate the wellsite system 100, the tool string 200, 201, the actuator modules 220, 222, 260, 270, and/or the engagement device 224 to perform the example methods and/or processes described herein. The processor 412 may be, comprise, or be implemented by one or more processors of various types suitable to the local application environment, and may include one or more of general-purpose computers, special-purpose computers, microprocessors, digital signal processors (DSPs), field-programmable gate arrays (FPGAs), application-specific integrated circuits (ASICs), and processors based on a multi-core processor architecture, as non-limiting examples. Of course, other processors from other families are also appropriate.

The processor 412 may be in communication with a main memory 417, such as may include a volatile memory 418 and a non-volatile memory 420, perhaps via a bus 422 and/or other communication means. The volatile memory 418 may be, comprise, or be implemented by random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 420 may be, comprise, or be implemented by read-only memory, flash memory, and/or other types of memory devices. One or more memory controllers (not shown) may control access to the volatile memory 418 and/or non-volatile memory 420.

The controller 410 may also comprise an interface circuit 424. The interface circuit 424 may be, comprise, or be implemented by various types of standard interfaces, such as an Ethernet interface, a universal serial bus (USB), a third generation input/output (3GIO) interface, a wireless interface, a cellular interface, and/or a satellite interface, among others. The interface circuit 424 may also comprise a graphics driver card. The interface circuit 424 may also comprise a communication device, such as a modem or network interface card to facilitate exchange of data with external computing devices via a network (e.g., Ethernet connection, digital subscriber line (DSL), telephone line, coaxial cable, cellular telephone system, satellite, etc.). One or more of the actuator and sensor equipment may be connected with the controller 410 via the interface circuit 424, such as may facilitate communication between the actuator and sensor equipment and the controller 410.

One or more input devices 426 may also be connected to the interface circuit 424. The input devices 426 may permit the wellsite operators to enter the coded instructions 432, including control commands, operational set-points, and/or other data for use by the processor 412. The operational set-points may include, as non-limiting examples, frequency of the vibrations generated by the actuator module 222, frequency of the alternating opposing axial movements imparted by the actuator modules 220, 270, magnitude of the vibrating force generated by the actuator module 222, magnitude of the substantially non-vibrating axial force generated by the actuator module 220, 270, distance of each alternating opposing axial movement imparted by the actuator modules 220, 270, and the force magnitude thresholds to be applied to the downhole apparatus 230 by the actuator modules 220, 222, 270, such as to control movement or operation of the downhole apparatus 230 or other member located within the wellbore 120. The input devices 426 may be, comprise, or be implemented by a keyboard, a mouse, a touchscreen, a track-pad, a trackball, an isopoint, and/or a voice recognition system, among other examples.

One or more output devices 428 may also be connected to the interface circuit 424. The output devices 428 may be, comprise, or be implemented by display devices (e.g., a liquid crystal display (LCD), a light-emitting diode (LED) display, or cathode ray tube (CRT) display), printers, and/or speakers, among other examples. The controller 410 may also communicate with one or more mass storage devices 430 and/or a removable storage medium 434, such as may be or include floppy disk drives, hard drive disks, compact disk (CD) drives, digital versatile disk (DVD) drives, and/or USB and/or other flash drives, among other examples.

The coded instructions 432 may be stored in the mass storage device 430, the main memory 417, the local memory 414, and/or the removable storage medium 434. Thus, the controller 410 may be implemented in accordance with hardware (perhaps implemented in one or more chips including an integrated circuit, such as an ASIC), or may be implemented as software or firmware for execution by the processor 412. In the case of firmware or software, the implementation may be provided as a computer program product including a non-transitory, computer-readable medium or storage structure embodying computer program code (i.e., software or firmware) thereon for execution by the processor 412.

The coded instructions 432 may include program instructions or computer program code that, when executed by the processor 412, may cause the wellsite system 100, the tool string 200, 201, the actuator modules 220, 222, 260, 270 and the engagement device 224 to perform methods, processes, and/or routines described herein. For example, the controller 410 may receive, process, and record the operational set-points entered by the human operator and the signals generated by the sensors 257, 259, 307, 311. Based on the received operational set-points and the signals generated by the sensors 257, 259, 307, 311, the controller 410 may send signals or information to the various actuators 219, 223, 225, 264, 278, valves 310, and/or the tensioning device 170 to automatically perform and/or undergo one or more operations or routines described herein or otherwise within the scope of the present disclosure. For example, the controller 410 may be operable to cause the actuator modules 220, 222, 270 to generate or apply the substantially non-vibrating and vibrating forces to the downhole device 230, as described above in association with graphs 15-19.

In view of the entirety of the present disclosure, including the claims and the figures, a person having ordinary skill in the art will readily recognize that the present disclosure introduces an apparatus comprising a downhole tool string for conveying within a wellbore, wherein the downhole tool string comprises: an engagement device operable to engage a downhole feature located within the wellbore; a first actuator operable to apply a substantially non-vibrating force to the engagement device while the engagement device is engaged with the downhole feature; and a second actuator operable to apply a vibrating force to the engagement device while the engagement device is engaged with the downhole feature.

The first actuator may comprise a hydraulic ram and/or a downhole tractor.

A valve installed in the wellbore may comprise the downhole feature. The substantially non-vibrating force and the vibrating force may be cooperatively for transitioning the valve between open and closed positions. The valve may comprise a sliding sleeve comprising the downhole feature.

The first actuator may apply the substantially non-vibrating force to the second actuator, such that the second actuator may apply a combination of the substantially non-vibrating and vibrating forces to the engagement device.

The first and second actuators may be simultaneously operable to apply the substantially non-vibrating and vibrating forces to the downhole feature, via the engagement device, to move the downhole feature within the wellbore.

The substantially non-vibrating force may be an uphole or downhole axial force to impart respective uphole or downhole movement of the downhole feature while the vibrating force simultaneously imparts vibration to the downhole feature.

The substantially non-vibrating force may be an axial force that changes between uphole and downhole directions to alternatingly impart uphole and downhole movements to the downhole feature, and the uphole and downhole movements may be of different distances to achieve a net uphole or downhole repositioning of the downhole feature. The axial force may change between uphole and downhole directions at a frequency of less than one hertz.

The vibrating force may be an axially vibrating force, a radially vibrating force, and/or a rotationally vibrating force.

The second actuator may comprise a rotor comprising alternating slots and protrusions, a rotary actuator operable to rotate the rotor, and a contact member operable to contact the rotor. The alternating slots and protrusions of the rotor may be operable to move the contact member in an oscillating manner as the rotor rotates to generate the vibrating force. The contact member may be connected with a housing of the vibratory actuator via a biasing member operable to transfer the vibrating force to the housing of the vibratory actuator.

The apparatus may further comprise a controller comprising a processor and a memory storing computer program code, wherein the controller may be operable to control the first and second actuators to apply the substantially non-vibrating and vibrating forces. The downhole tool string may comprise the controller. The apparatus may further comprise surface equipment disposed at a wellsite surface from which the wellsite extends, wherein the downhole tool string may be in electrical or optical communication with the surface equipment, and wherein the surface equipment may comprise at least a portion of the controller. The downhole tool string may further comprise a sensor operable to generate information indicative of a position of the downhole feature within the wellbore, and the controller may be operable to record the information. The downhole tool string may further comprise a sensor operable to generate information indicative of at least one of the substantially non-vibrating and vibrating forces, and the controller may be operable to record the information.

The downhole tool string may further comprise an anchor device operable to maintain at least a portion of the downhole tool string in a predetermined position within the wellbore.

The present disclosure also introduces a method comprising: operating a first actuator to impart a substantially non-vibrating force to a downhole feature located within a wellbore; and operating a second actuator to impart a vibrating force to the downhole feature.

The first actuator may comprise a hydraulic ram and/or a downhole tractor.

The method may further comprise conveying a downhole tool string within the wellbore, wherein the downhole tool string comprises the first and second actuators. The method may further comprise operating an anchor device to maintain at least a portion of the downhole tool string in a predetermined position within the wellbore.

The method may further comprise: engaging an engagement device with the downhole feature; and imparting the substantially non-vibrating and vibrating forces to the downhole feature via the engagement device. The first actuator may impart the substantially non-vibrating force to the second actuator, such that the second actuator may impart a combination of the substantially non-vibrating and vibrating forces to the engagement device. The first and second actuators may simultaneously impart the substantially non-vibrating and vibrating forces to the downhole feature, via the engagement device, to move the downhole feature within the wellbore.

A valve installed in the wellbore may comprise the downhole feature. The method may further comprise transitioning the valve between open and closed positions with the substantially non-vibrating force and the vibrating force. The valve may comprise a sliding sleeve comprising the downhole feature.

The substantially non-vibrating force may be an uphole or downhole axial force imparting respective uphole or downhole movement of the downhole feature while the vibrating force simultaneously imparts vibration to the downhole feature.

The substantially non-vibrating force may be an axial force that changes between uphole and downhole directions to alternatingly impart uphole and downhole movements to the downhole feature, and the uphole and downhole movements may be of different distances to achieve a net uphole or downhole repositioning of the downhole feature. The axial force may change between uphole and downhole directions at a frequency of less than one hertz.

The vibrating force may be an axially vibrating force, a radially vibrating force, and/or a rotationally vibrating force.

The second actuator may comprise: a rotor comprising alternating slots and protrusions; a rotary actuator operable to rotate the rotor; and a contact member operable to contact the rotor. The alternating slots and protrusions of the rotor may move the contact member in an oscillating manner as the rotor rotates to generate the vibrating force. The contact member may be connected with a housing of the vibratory actuator via a biasing member, and the biasing member may transfer the vibrating force to the housing of the vibratory actuator.

The method may further comprise operating a controller comprising a processor and a memory storing computer program code to control the first and second actuators to impart the substantially non-vibrating and vibrating forces. The method may further comprise conveying a downhole tool string within the wellbore, wherein the downhole tool string comprises the controller. The method may further comprise operating surface equipment disposed at a wellsite surface from which the wellsite extends to electrically or optically communicate with the first and second actuators, wherein the surface equipment may comprise at least a portion of the controller. The method may further comprise: operating a sensor to generate information indicative of a position of the downhole feature within the wellbore; and operating the controller to record the information. The method may further comprise: operating a sensor to generate information indicative of at least one of the substantially non-vibrating and vibrating forces; and operating the controller to record the information.

The present disclosure also introduces a method comprising: positioning a downhole tool string relative to a downhole feature within a wellbore, wherein the downhole tool string is in communication with surface equipment disposed at a wellsite surface from which the wellbore extends, and wherein the downhole tool string and/or the surface equipment individually or collectively comprise a controller comprising a processor and a memory storing computer program code; engaging the downhole feature with an engagement device of the downhole tool string; and operating the controller to control an actuator of the downhole tool string to impart movements to the engagement device and the downhole feature in first and second directions, wherein the movements are of different distances to achieve a net repositioning of the downhole feature in the first or second direction.

The first and second directions may be axially opposite directions.

The movements may change between the first and second directions at a frequency of less than one hertz.

The movements may change between the first and second directions at a frequency of greater than fifty hertz.

The actuator may be a first actuator operable to impart a substantially non-vibrating force to the engagement device, and operating the controller may further comprise controlling a second actuator of the downhole tool string to impart a vibrating force to the engagement device simultaneously with the substantially non-vibrating force.

Operating the controller to impart the movements may be based on information generated by a position sensor of the downhole tool string operable to generate information indicative of a position of the downhole feature. Operating the controller to impart the movements may also or instead be based on information generated by a force sensor of the downhole tool string operable to generate information indicative of a force applied by the actuator to impart the movements.

The downhole feature may be in a first position when initially engaged by the engagement device, the net repositioning of the downhole feature may be in the first direction to a second position, and each successive one of the movements in the first direction may move the downhole feature closer to the second position than resulted from the previous movements in the first direction. The movements in the second direction may each be of substantially the same distance.

A valve installed in the wellbore may comprise the downhole feature. The valve may comprise a sliding sleeve comprising the downhole feature.

The method may further comprise operating the controller to control an anchor device of the downhole tool string to positionally fix at least a portion of the downhole tool string within the wellbore.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. A method comprising:

conveying a powered downhole tool string within a wellbore, wherein the down hole tool string comprises a first actuator and a second actuator; operating the first actuator to impart a substantially non-vibrating force to a down hole feature located within the wellbore; operating the second actuator to impart a vibrating force to the downhole feature, and operating a controller to control one or both of the first and second actuators of the downhole tool string to impart movements to the downhole feature in first and second directions, wherein the movements are of different distances to achieve a net repositioning of the down hole feature in the first or second direction.

2. The method of claim 1, further comprising operating an anchor device to maintain at least a portion of the downhole tool string in a predetermined position within the wellbore.

3. The method of claim 1, further comprising:

engaging an engagement device with the downhole feature; and imparting the substantially non-vibrating and vibrating forces to the downhole feature via the engagement device.

4. The method of claim 1, wherein a valve installed in the wellbore comprises the downhole feature, and wherein the method further comprises transitioning the valve between open and closed positions with the substantially non-vibrating force and the vibrating force.

5. The method of claim 1, wherein the substantially non-vibrating force is an axial force, and wherein the vibrating force is at least one of an axially vibrating force, a radially vibrating force, and/or a rotationally vibrating force.

6. The method of claim 1, further comprising operating the controller comprising a processor and a memory storing computer program code to control the first and second actuators to impart the substantially non-vibrating and vibrating forces.

7. The method of claim 1, further comprising operating the controller to adjust a magnitude and frequency of the vibrating force.

8. The method of claim 1, wherein the vibrating force is continuous and repeatable.

9. The method of claim 1, wherein the substantially non-vibrating force is a rotational force or a torque, and wherein the vibrating force is at least one of an axially vibrating force, a radially vibrating force, and/or a rotationally vibrating force.

10. A method comprising:

positioning a powered downhole tool string relative to a downhole feature of a movable member within a wellbore, wherein the downhole tool string is in communication with surface equipment disposed at a wellsite surface from which the wellbore extends, and wherein the downhole tool string and/or the surface equipment individually or collectively comprise a controller comprising a processor and a memory storing computer program code; engaging the downhole feature with an engagement device of the downhole tool string; and operating the controller to control an actuator of the downhole tool string to impart movements to the engagement device and the downhole feature in first and second directions, wherein the movements are of different distances to achieve a net repositioning of the downhole feature in the first or second direction in response to resistance to movement of the movable member falling within a second predetermined threshold range that is between a first predetermined threshold range and a third predetermined threshold range, wherein the actuator is controlled differently in response to the resistance to movement falling within the first predetermined threshold range or the third predetermined threshold range.

11. The method of claim 10, wherein the actuator is a first actuator operable to impart a substantially non-vibrating force to the engagement device, and wherein operating the controller further comprises controlling a second actuator of the downhole tool string to impart a vibrating force to the engagement device simultaneously with the substantially non-vibrating force.

12. The method of claim 10, wherein operating the controller to impart the movements is based on information generated by at least one of:

a position sensor of the downhole tool string operable to generate information indicative of a position of the downhole feature; and/or a force sensor of the downhole tool string operable to generate information indicative of a force applied by the actuator to impart the movements.

13. The method of claim 10, wherein the downhole feature is in a first position when initially engaged by the engagement device, wherein the net repositioning of the downhole feature is in the first direction to a second position, and wherein each successive one of the movements in the first direction moves the downhole feature closer to the second position than resulted from the previous movements in the first direction.

14. The method of claim 10, wherein the controller automatically adjusts the non-vibrating and vibrating forces based on sensor feedback to apply forces to the downhole feature.

* * * * *